US012129604B2

(12) United States Patent
Xiao et al.

(10) Patent No.: US 12,129,604 B2
(45) Date of Patent: Oct. 29, 2024

(54) INNER GUIDE TYPE RAIL SWITCH AND RAIL TRANSIT SYSTEM HAVING SAME

(71) Applicant: BYD COMPANY LIMITED, Shenzhen (CN)

(72) Inventors: Xiaobin Xiao, Shenzhen (CN); Yongqiang Xu, Shenzhen (CN); Yilei Wang, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 667 days.

(21) Appl. No.: 17/598,645

(22) PCT Filed: Mar. 27, 2020

(86) PCT No.: PCT/CN2020/081789
§ 371 (c)(1),
(2) Date: Sep. 27, 2021

(87) PCT Pub. No.: WO2020/192771
PCT Pub. Date: Oct. 1, 2020

(65) Prior Publication Data

US 2022/0162807 A1 May 26, 2022

(30) Foreign Application Priority Data

Mar. 28, 2019 (CN) ..... 201910244206.1

(51) Int. Cl.
*E01B 7/18* (2006.01)
*E01B 7/00* (2006.01)
*E01B 7/14* (2006.01)

(52) U.S. Cl.
CPC ..... *E01B 7/18* (2013.01); *E01B 7/00* (2013.01); *E01B 7/14* (2013.01)

(58) Field of Classification Search
CPC ..... E01B 7/00; E01B 7/02; E01B 7/04; E01B 7/06; E01B 7/08; E01B 7/10; E01B 7/12; E01B 7/14; E01B 7/16; E01B 7/18; E01B 7/20; E01B 7/22; E01B 7/24; E01B 7/26; E01B 7/28; E01B 7/30
USPC ..... 104/130.06, 130.09, 102, 245, 246, 247; 246/417, 382, 383, 384, 385, 416
See application file for complete search history.

(56) References Cited

U.S. PATENT DOCUMENTS 280,215 A * 6/1883 Millerstedt ..... E01B 7/18 246/410
1,252,662 A 1/1918 Cobb
4,774,891 A 10/1988 Coester

FOREIGN PATENT DOCUMENTS

CN 201330355 Y 10/2009
CN 201614526 U 10/2010
CN 204982560 U 1/2016
(Continued)

OTHER PUBLICATIONS

International Search Report and Written Opinion for Application No. PCT/CN2020/081789, mailed on May 21, 2020, 9 pages.

*Primary Examiner* — Zachary L Kuhfuss
*Assistant Examiner* — Heaven R Buffington

(57) ABSTRACT

An inner guide rail switch and a rail transit system having same. The inner guide rail switch includes a fixed beam assembly and a movable beam assembly. Four passageways are defined by the fixed beam assembly. The movable beam assembly includes six movable beams. The four passageways are switched through combined movement of the six movable beams.

15 Claims, 9 Drawing Sheets

(56) References Cited

FOREIGN PATENT DOCUMENTS

| | | | | | |
|---|---|---|---|---|---|
| CN | 107815934 | A | 3/2018 | | |
| CN | 207567578 | U | 7/2018 | | |
| CN | 207809420 | U | 9/2018 | | |
| CN | 108842526 | A | 11/2018 | | |
| CN | 208183450 | U | 12/2018 | | |
| CN | 208530595 | U | 2/2019 | | |
| JP | S5716025 | B2 | 4/1982 | | |
| JP | 2006200267 | A | 8/2006 | | |
| WO | WO-2015129524 | A1 * | 9/2015 | ..... | B61B 13/00 |

* cited by examiner

INNER GUIDE TYPE RAIL SWITCH AND RAIL TRANSIT SYSTEM HAVING SAME

CROSS-REFERENCE TO RELATED APPLICATIONS

This application is a national phase entry of International Patent Application No. PCT/CN2020/081789, filed on Mar. 27, 2020, which is based on and claims priority to and benefits of Chinese Patent Application Serial No. 201910244206.1, filed with the State Intellectual Property Office of P. R. China on Mar. 28, 2019. The entire content of the above-referenced applications is incorporated herein by reference.

FIELD

This application relates to the field of rail transit technologies, and in particular to a rail switch of an inner guide type and a rail transit system having same.

BACKGROUND

For inner guide rail switches in the related art, the entire rail switch beam needs to be moved during switching. In other words, the entire rail switch beam with a passageway needs to be moved from one position to another position to allow the train to change on another track to travel. However, due to the heavy weight of the rail switch beam, the operation of moving the rail switch beam is time-consuming and laborious. In addition, the rail switch beam as a whole is likely to be damaged during the movement, and requires frequent maintenance.

SUMMARY

This application aims to resolve at least one of the technical problems in the related art. In view of this, this application provides an inner guide rail switch, which features a small size, convenient switching, and low costs.

This application also provides a rail transit system including the above inner guide rail switch.

A first aspect of this application provides an inner guide rail switch, including: a fixed beam assembly, where the fixed beam assembly defines: four forks, where the four forks are a first fork, a second fork, a third fork, and a fourth fork, the four forks are respectively located at four corners of a quadrilateral, the first fork and the third fork are arranged diagonally, and the second fork and the fourth fork are arranged diagonally; and four passageways, where the four passageways are a first passageway, a second passageway, a third passageway, a fourth passageway, the first passageway connects the first fork and the second fork, the second passageway connects the first fork and the third fork, the third passageway connects the fourth fork and the second fork, and the fourth passageway connects the fourth fork and the third fork; and a movable beam assembly, where the movable beam assembly includes: a first movable beam, where the first movable beam is movably arranged at the first fork and is configured to switch one of the first passageway and the second passageway to allow passage; a second movable beam, where the second movable beam is movably arranged at the second fork and is configured to switch one of the first passageway and the third passageway to allow passage; a third movable beam, where the third movable beam is movably arranged at the third fork and is configured to switch one of the second passageway and the fourth passageway to allow passage; a fourth movable beam, where the fourth movable beam is movably arranged at the fourth fork and is configured to switch one of the third passageway and the fourth passageway to allow passage; a fifth movable beam, where the fifth movable beam is movably arranged on one side of an intersection of the second passageway and the third passageway close to the first fork and the fourth fork, and is configured to switch one of the second passageway and the third passageway to allow passage; and a sixth movable beam, where the sixth movable beam is movably arranged on one side of the intersection of the second passageway and the third passageway close to the second fork and the third fork, and is configured to switch one of the second passageway and the third passageway to allow passage. The inner guide rail switch of this application features a small size, convenient switching, and low costs.

A second aspect of this application provides a rail transit system including the inner guide rail switch according to the first aspect of this application.

According to the rail transit system of this application, the overall performance of the rail transit system is improved by the configuration of the inner guide rail switch according to the first aspect.

Other aspects and advantages of this application will be given in the following description, some of which will become apparent from the following description or may be learned from practices of this application.

Figure 1:
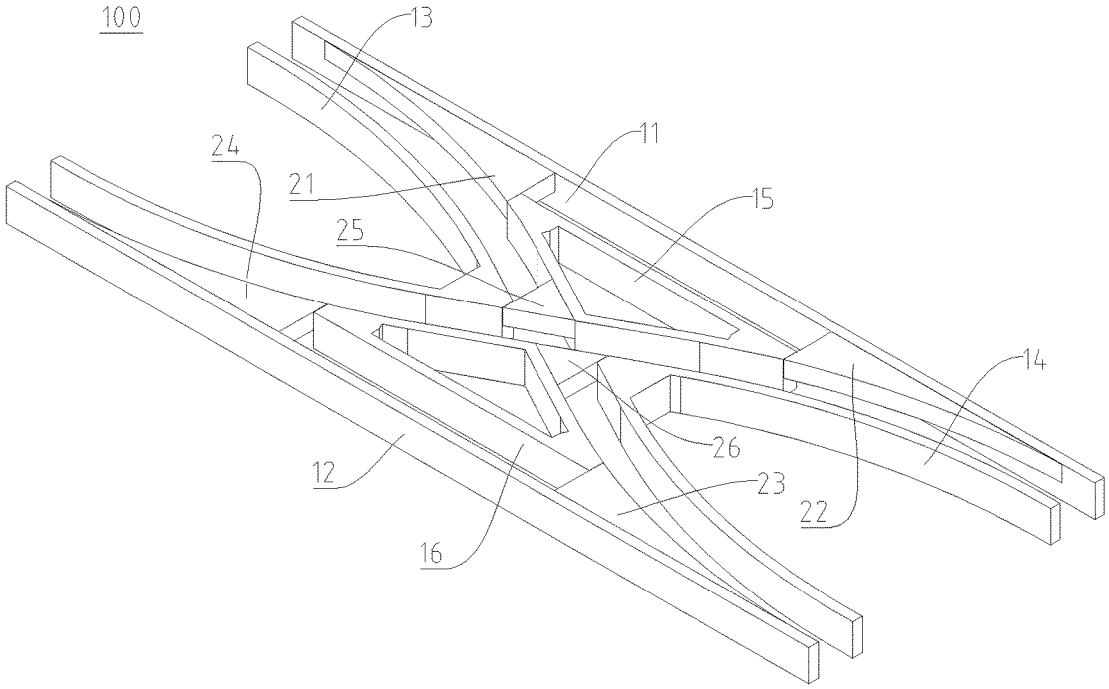
FIG. 1 is a perspective view of an inner guide rail switch according to an embodiment of this application.

LIST OF REFERENCE NUMERALS rail transit system 1000;
inner guide rail switch 100;
fixed beam assembly 1;
first fork 101; second fork 102; third fork 103; fourth fork 104;
first passageway 01; R11 section 011; R12 section 012; R13 section 013;
second passageway 02; R21 section 021; R22 section 022; R23 section 023; R24 section 024; R25 section 025;
third passageway 03; R31 section 031; R32 section 032; R33 section 033; R34 section 034; R35 section 035;
fourth passageway 04; R41 section 041; R42 section 042; R43 section 043;
first fixed beam 11; L11 side beam section 111; L12 side beam section 112; L13 side beam section 113;
second fixed beam 12; L21 side beam section 121; L22 side beam section 122; L23 side beam section 123;
third fixed beam 13; L31 side beam section 131; L32 side beam section 132; L33 side beam section 133; L34 side beam section 134;
first beam section 13*a*; second beam section 13*b*; third beam section 13*c;*
fourth fixed beam 14; L41 side beam section 141; L42 side beam section 142; L43 side beam section 143; L44 side beam section 144;
fourth beam section 14*a*; fifth beam section 14*b*; sixth beam section 14*c;*
fifth fixed beam 15; L51 side beam section 151; L52 side beam section 152; L53 side beam section 153;
sixth fixed beam 16; L61 side beam section 161; L62 side beam section 162; L63 side beam section 163;
movable beam assembly 2;
first movable beam 21; F11 surface 211; F12 surface 212; F13 surface 213;
second movable beam 22; F21 surface 221; F22 surface 222; F23 surface 223;
third movable beam 23; F31 surface 231; F32 surface 232; F33 surface 233;
fourth movable beam 24; F41 surface 241; F42 surface 242; F43 surface 243;
fifth movable beam 25; F51 surface 251; F52 surface 252; F53 surface 253;
sixth movable beam 26; F61 surface 261; F62 surface 262; F63 surface 263;
vehicle 200; guide wheel 201; walking wheel 202; and track beam 300.

DETAILED DESCRIPTION

The following describes embodiments of this application in detail. Examples of the embodiments are shown in the accompanying drawings. In the accompanying drawings, the same or similar elements and elements having same or similar functions are denoted by same or similar reference numerals throughout the descriptions. The following embodiments described with reference to the accompanying drawings are exemplary to describe this application, and are not limitations to this application.

Many different embodiments or examples are provided below to implement different structures of this application. To simplify the disclosure of this application, the following describes components and settings of particular examples. Certainly, the components and settings are merely examples, and do not limit this application. In addition, in this application, reference numerals and/or letters may be repeated in different examples, but such repetitions are for simplification and clarity, which do not indicate relationships between the embodiments and/or settings discussed. Moreover, this application provides examples of various particular processes and materials, but a person of ordinary skill in the art may be aware of application of another process and/or use of another material.

An inner guide rail switch 100 according to the embodiments of this application will be described below with reference to the accompanying drawings.

Specifically, the inner guide rail switch 100 according to the embodiments of this application can be used in a rail transit system 1000, so the rail transit system 1000 including the inner guide rail switch 100 can have the same advantages as the inner guide rail switch 100. The concept and other components of the rail transit system 1000, such as a subway system, a light rail system, etc., are well known to those skilled in the art, and therefore will not be described in detail herein. In addition, other components of the rail transit system 1000 according to the embodiments of this application, such as a vehicle 200 and a track beam 300, are known to those of ordinary skill in the art, and therefore will not be described in detail herein.

Figure 2:
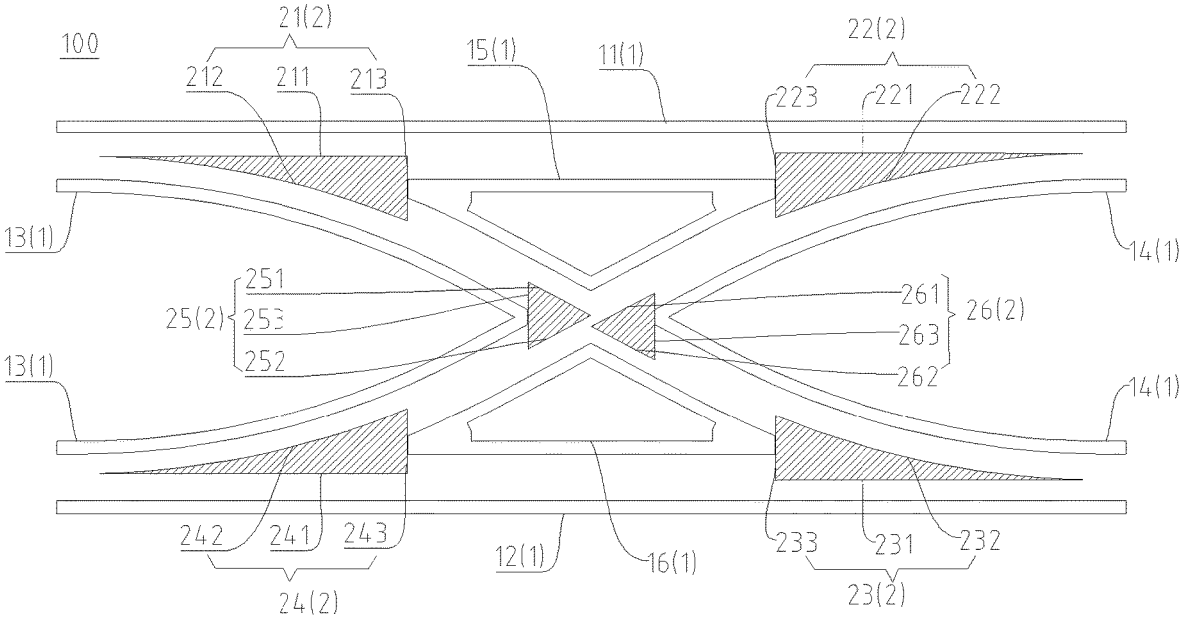
FIG. 2 is a top view of the inner guide rail switch shown in FIG. 1.

As shown in FIG. 1 and FIG. 2, the inner guide rail switch 100 may include: a fixed beam assembly 1 and a movable beam assembly 2. Four forks and four passageways are defined by the fixed beam assembly 1. The movable beam assembly 2 includes: a first movable beam 21, a second movable beam 22, a third movable beam 23, a fourth movable beam 24, a fifth movable beam 25, and a sixth movable beam 26. The fixed beam assembly 1 (including each of the fixed beams) is fixed, and the movable beam assembly 2 (including each of the movable beams) is movable relative to the fixed beam assembly 1.

Figure 3:
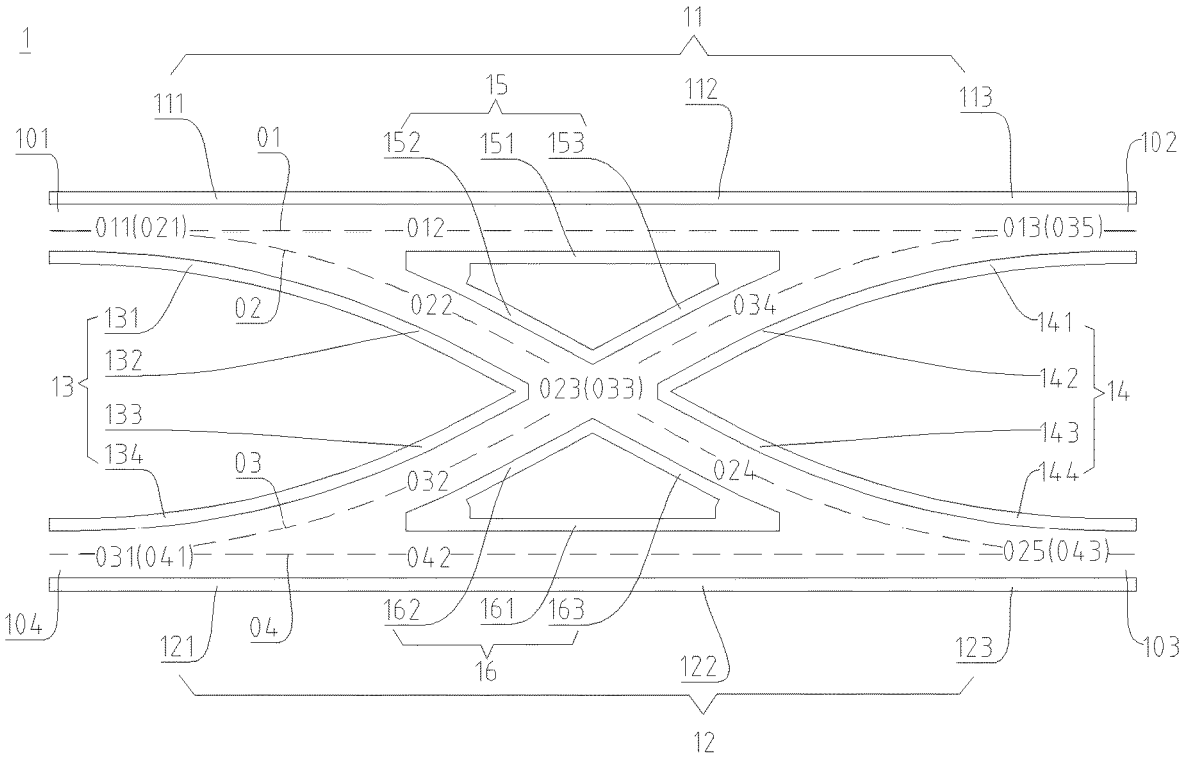
FIG. 3 is a top view of the fixed beam assembly shown in FIG. 2.

Referring to FIG. 3, the four forks are a first fork 101, a second fork 102, a third fork 103, and a fourth fork 104. The four forks are respectively located at four corners of a quadrilateral, the first fork 101 and the third fork 103 are arranged diagonally, and the second fork 102 and the fourth fork 104 are arranged diagonally. The four passageways are a first passageway 01, a second passageway 02, a third passageway 03, and a fourth passageway 04. The first passageway 01 connects the first fork 101 and the second fork 102, the second passageway 02 connects the first fork 101 and the third fork 103, the third passageway 03 connects the fourth fork 104 and the second fork 102, and the fourth passageway 04 connects the fourth fork 104 and the third fork 103.

As shown in FIG. 1 and FIG. 2, the first movable beam 21 is movably arranged at the first fork 101 and is configured to move in a union area of the first passageway 01 and the second passageway 02 to switch one of the first passageway 01 and the second passageway 02 to allow passage. The second movable beam 22 is movably arranged at the second fork 102 and is configured to move in a union area of the first passageway 01 and the third passageway 03 to switch one of the first passageway 01 and the third passageway 03 to allow passage. The third movable beam 23 is movably arranged at the third fork 103 and is configured to move in a union area of the second passageway 02 and the fourth passageway 04 to switch one of the second passageway 02 and the fourth passageway 04 to allow passage. The fourth movable beam 24 is movably arranged at the fourth fork 104 and is configured to move in a union area of the third passageway 03 and the fourth passageway 04 to switch between one of the third passageway 03 and the fourth passageway 04 to allow passage. The fifth movable beam 25 is movably arranged on a side of an intersection of the second passageway 02 and the third passageway 03 close to the first fork 101 and the fourth fork 104, and is configured to move in a union area of the second passageway 02 and the third passageway 03 to switch one of the second passageway 02 and the third passageway 03 to allow passage. The sixth movable beam 26 is movably arranged on a side of the intersection of the second passageway 02 and the third passageway 03 close to the second fork 102 and the third fork 103, and is configured to move in the union area of the second passageway 02 and the third passageway 03 to switch one of the second passageway 02 and the third passageway 03 to allow passage. It is to be understood that the union area mentioned in this specification includes not only all areas of one passageway, but also all areas of another passageway. Taking the union area of the first passageway 01 and the second passageway 02 as an example, the union area of the passageway 01 and the second passageway 02 includes all the areas of the first passageway 01 and all areas of the second passageway 02.

Figure 5:
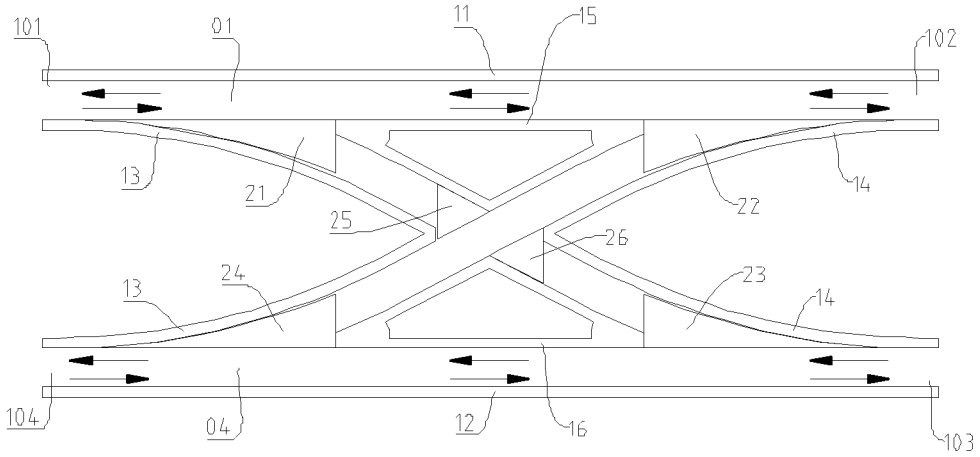
FIG. 5 is a schematic diagram showing a first passage-permitted state and a fourth passage-permitted state of the inner guide rail switch of FIG. 2.

As shown in FIG. 5, when the first movable beam 21 moves to a position that allows passage in the first passageway 01 and blocks the second passageway 02, and the second movable beam 22 moves to a position that allows passage in the first passageway 01 and blocks the third passageway 03. The first movable beam 21 and the second movable beam 22 can fill a side beam gap of the first passageway 01, and provide functions of guiding guide wheels 201 of the vehicle 200 and supporting walking wheels 202 of the vehicle 200, so that the inner guide rail switch 100 presents at a first passage-permitted state allowing passage in the first passageway 01.

Figure 6:
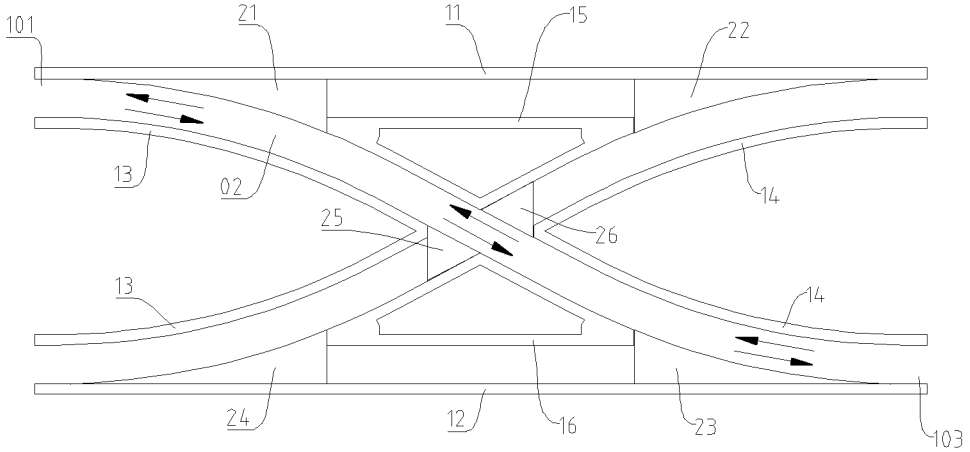
FIG. 6 is a schematic diagram showing a second passage-permitted state of the inner guide rail switch of FIG. 2.

As shown in FIG. 6, when the first movable beam 21 moves to a position that allows passage in the second passageway 02 and blocks the first passageway 01, the third movable beam 23 moves to a position that allows passage in the second passageway 02 and blocks the fourth passageway 04, and the fifth movable beam 25 and the sixth movable beam 26 both move to a position that allows passage in the second passageway 02 and blocks the third passageway 03. The first movable beam 21, the third movable beam 23, the fifth movable beam 25, and the sixth movable beam 26 can fill a side beam gap of the second passageway 02, and guide the guide wheels 201 of the vehicle 200 and support the walking wheels 202 of the vehicle 200, so that the inner guide rail switch 100 presents at a second passage-permitted state allowing passage in the second passageway 02.

Figure 7:
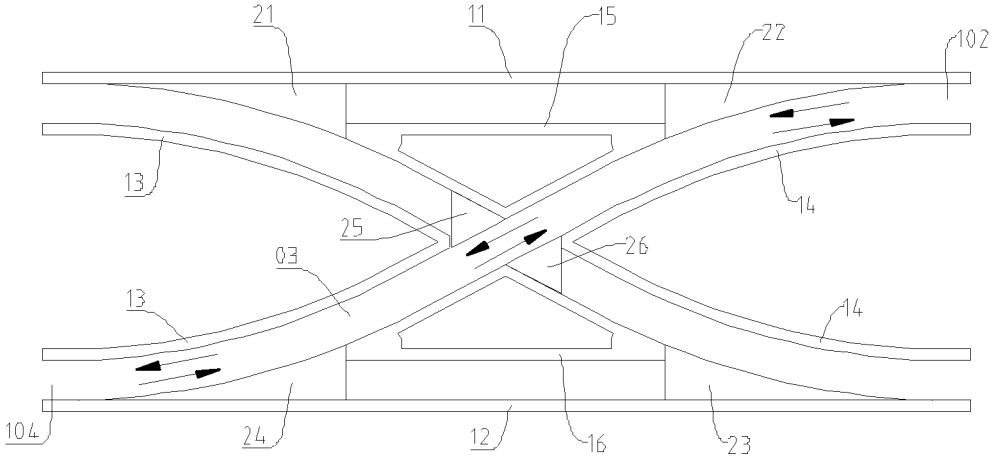
FIG. 7 is a schematic diagram showing a third passage-permitted state of the inner guide rail switch of FIG. 2.

As shown in FIG. 7, when the fourth movable beam 24 moves to a position that allows passage in the third passageway 03 and blocks the fourth passageway 04, the second movable beam 22 moves to a position that allows passage in the third passageway 03 and blocks the first passageway 01, and the fifth movable beam 25 and the sixth movable beam 26 both move to a position that allows passage in the third passageway 03 and blocks the second passageway 02. The fourth movable beam 24, the second movable beam 22, the fifth movable beam 25, and the sixth movable beam 26 can fill a side beam gap of the third passageway 03, and provide guiding for the guide wheels 201 of the vehicle 200 and supporting for the walking wheels 202 of the vehicle 200, so that the inner guide rail switch 100 presents at a third passage-permitted state allowing passage in the third passageway 03.

As shown in FIG. 5, when the fourth movable beam 24 moves to a position that allows passage in the fourth passageway 04 and blocks the third passageway 03, and the third movable beam 23 moves to a position that allows passage in the fourth passageway 04 and blocks the second passageway 02. The fourth movable beam 24 and the third movable beam 23 can fill a side beam gap of the fourth passageway 04, and guide the guide wheels 201 of the vehicle 200 and support the walking wheels 202 of the vehicle 200, so that the inner guide rail switch 100 presents at a first passage-permitted state allowing passage in the fourth passageway 04.

Therefore, the inner guide rail switch 100 according to the embodiments of this application has an ingenious structure, and can switch among the four passage-permitted states by moving the positions of the movable beams of the movable beam assembly 2 so as to meet various actual traffic requirements. Moreover, because each of the movable beams of the movable beam assembly 2 is configured to move in the union area of the corresponding passageways, the movable beams will not occupy extra space outside the passageways during the movement process, thereby achieving a small overall size and low costs of the inner guide rail switch 100. In addition, because of the inner guide rail switch 100, there is no need to move the entire rail switch beam, so the driving force required on each movable beam is reduced, thereby reducing the difficulty in setting up the driving device and allowing for swift switching.

In addition, it should be noted that the fixing mode for the fixed beam assembly 1 (including each fixed beam) is not limited. For example, each fixed beam may be fixed to a base support, and the support base may be welded to a rail switch platform. The movement mode and driving mode for the movable beam assembly 2 (including each movable beam) are not limited. For example, each movable beam may be fixed to a corresponding trolley, the trolley includes a driving device, and the driving device drives the trolley to move so as to cause the corresponding movable beam to move. Certainly, this application is not limited thereto.

In some embodiments of this application, as shown in FIG. 3, the fixed beam assembly 1 may include: a first fixed beam 11, a second fixed beam 12, a third fixed beam 13, a fourth fixed beam 14, a fifth fixed beam 15, and a sixth fixed beam 16. The first fixed beam 11 extends from the first fork 101 to the second fork 102. The second fixed beam 12 extends from the fourth fork 104 to the third fork 103. The third fixed beam 13 and the fourth fixed beam 14 are both located between the first fixed beam 11 and the second fixed beam 12. The third fixed beam 13 is located closer to the first fork 101 and the fourth fork 104 than the fourth fixed beam 14 is (that is, the fourth fixed beam 14 is located closer to the second fork 102 and the third fork 103 than the third fixed beam 13 is, that is to say, the third fixed beam 13 and the fourth fixed beam 14 are arranged in sequence along a direction from the first fork 101 to the second fork 102, or the third fixed beam 13 and the fourth fixed beam 14 are arranged in sequence along a direction from the fourth fork 104 to the third fork 103). The fifth fixed beam 15 is located on a side of the third fixed beam 13 and the fourth fixed beam 14 close to the first fixed beam 11 (so the fifth fixed beam 15 arranged opposite to a middle part of the first fixed beam 11). The sixth fixed beam 16 is located on a side of the third fixed beam 13 and the fourth fixed beam 14 close to the second fixed beam 12 (so the sixth fixed beam 16 is arranged opposite to a middle part of the second fixed beam 12). Therefore, the fixed beam assembly 1 has a simple structure, is easy to process and install, has low investment costs, and has a small overall size.

In some embodiments of this application, as shown in FIG. 3, each of the first fixed beam 11, the second fixed beam 12, the third fixed beam 13, the fourth fixed beam 14, the fifth fixed beam 15, and the sixth fixed beam 16 may include one or more equal-width beams. This shows that each fixed beam is not a solid block, which reduces the weight and costs of each fixed beam, thereby reducing the overall weight, costs, and construction difficulty of the inner guide rail switch 100.

Figure 8:
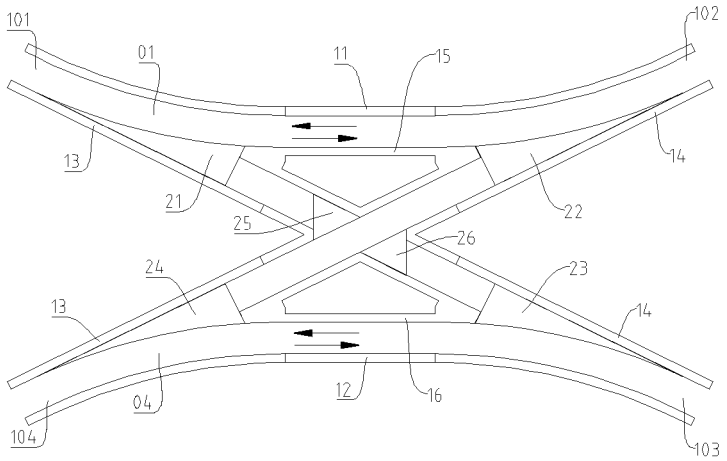
FIG. 8 is a schematic diagram of an inner guide rail switch at a first passage-permitted state and a fourth passage-permitted state according to another embodiment of this application.

For example, in the specific embodiment shown in FIG. 3, the first fixed beam 11 may include one equal-width side beam which includes an L11 side beam section 111, an L12 side beam section 112, and an L13 side beam section 113 connected in sequence. Certainly, this application is not limited thereto, and the first fixed beam 11 may also be assembled with a plurality of separately processed equal-width beams. For example, as shown in FIG. 8, when the first fixed beam 11 does not extend along a straight line, it may be assembled with a plurality of separately processed equal-width beams, thereby reducing the processing difficulty of the first fixed beam 11 and reducing the production costs.

For example, in the specific embodiment shown in FIG. 3, the second fixed beam 12 may include one equal-width side beam which includes an L21 side beam section 121, an L22 side beam section 122, and an L23 side beam section 123 connected in sequence. Certainly, this application is not limited thereto, and the second fixed beam 12 may also be assembled with a plurality of separately processed equal-width beams. For example, as shown in FIG. 8, when the second fixed beam 12 does not extend along a straight line, it may be assembled with a plurality of separately processed equal-width beams, thereby reducing the processing difficulty of the second fixed beam 12 and reducing the production costs.

Figure 4:
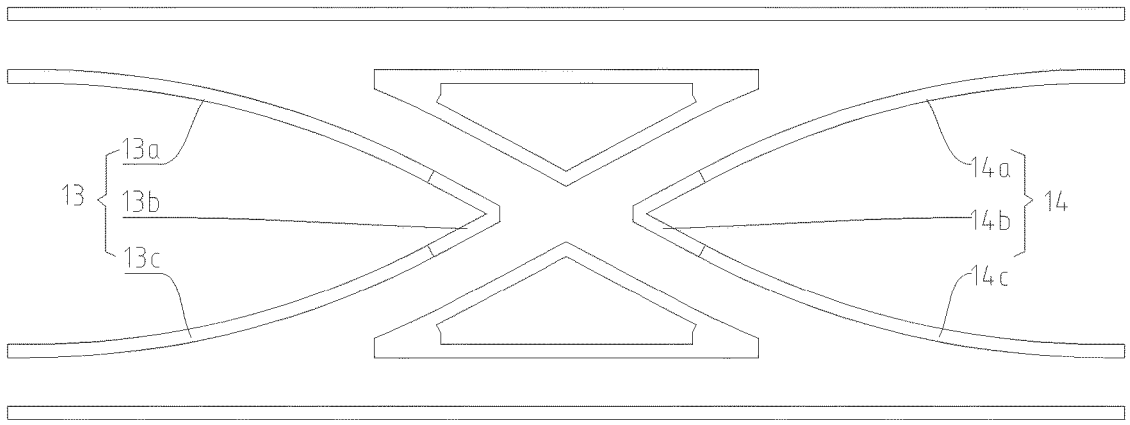
FIG. 4 is a top view of a fixed beam assembly according to another embodiment of this application.

For example, in the specific embodiment shown in FIG. 3, the third fixed beam 13 may include one equal-width side beam which includes an L31 side beam section 131, an L32 side beam section 132, an L33 side beam section 133, and an L34 side beam section 134 connected in sequence. Certainly, this application is not limited thereto, and the third fixed beam 13 may also be assembled with a plurality of separately processed equal-width beams. For example, as shown in FIG. 4, the third fixed beam 13 may also be assembled with three separately processed equal-width beams: a first beam section 13*a*, a second beam section 13*b*, and a third beam section 13*c*. In other words, the first beam section 13*a*, the second beam section 13*b*, and the third beam section 13*c* are separately processed equal-width beams, which are assembled together by a subsequent assembly process to constitute the third fixed beam 13, thereby reducing the overall processing difficulty of the third fixed beam 13 and reducing the production costs.

For example, in the specific embodiment shown in FIG. 3, the fourth fixed beam 14 may include one equal-width side beam which includes an L41 side beam section 141, an L42 side beam section 142, an L43 side beam section 143, and an L44 side beam section 144 connected in sequence. Certainly, this application is not limited thereto, and the fourth fixed beam 14 may also be assembled with a plurality of separately processed equal-width beams. For example, as shown in FIG. 4, the fourth fixed beam 14 may also be assembled with three separately processed equal-width beams: a fourth beam section 14*a*, a fifth beam section 14*b*, and a sixth beam section 14*c*. In other words, the fourth beam section 14*a*, the fifth beam section 14*b*, and the sixth beam section 14*c* are separately processed equal-width beams, which are assembled together by a subsequent assembly process to constitute the fourth fixed beam 14, thereby reducing the overall processing difficulty of the fourth fixed beam 14 and reducing the production costs.

For example, in the specific embodiment shown in FIG. 3, the fifth fixed beam 15 may include one beam with equal-width which includes an L51 side beam section 151, an L52 side beam section 152, an L53 side beam section 153 connected in sequence in a triangular shape (that is, the L51 side beam section 151, the L52 side beam section 152, and the L53 side beam section 153 constitute three sides of a triangle). Certainly, this application is not limited thereto, and the fifth fixed beam 15 may also be assembled with a plurality of separately processed equal-width beams, thereby reducing the processing difficulty of the fifth fixed beam 15 and reducing the production costs.

For example, in the specific embodiment shown in FIG. 3, the sixth fixed beam 16 may include one beam with equal-width which includes an L61 side beam section 161, an L62 side beam section 162, an L63 side beam section 163 connected in sequence in a triangular shape (that is, the L61 side beam section 161, the L62 side beam section 162, and the L63 side beam section 163 constitute three sides of a triangle). Certainly, this application is not limited thereto, and the sixth fixed beam 16 may also be assembled with a plurality of separately processed equal-width beams, thereby reducing the processing difficulty of the sixth fixed beam 16 and reducing the production costs.

As shown in FIG. 3, the first fork 101 is located between the first fixed beam 11 and the third fixed beam 13, the second fork 102 is located between the first fixed beam 11 and the fourth fixed beam 14, the third fork 103 is located between the second fixed beam 12 and the fourth fixed beam 14, and the fourth fork 104 is located between the second fixed beam 12 and the third fixed beam 13.

As shown in FIG. 3, the first passageway 01 includes an R11 section 011, an R12 section 012, and an R13 section 013 arranged in sequence. The R11 section 011 is located between the first fixed beam 11 and the third fixed beam 13 (for example, the R11 section 011 is located between the L11 side beam section 111 and the L31 side beam section 131). The R12 section 012 is located between the first fixed beam 11 and the fifth fixed beam 15 (for example, the R12 section 012 is located between the L12 side beam section 112 and the L51 side beam section 151). The R13 section 013 is located between the first fixed beam 11 and the fourth fixed beam 14 (for example, the R13 section 013 is located between the L13 side beam section 113 and the L41 side beam section 141). Therefore, the fixed beam assembly 1 has a simple structure, and the first passageway 01 can be defined easily and efficiently.

As shown in FIG. 3, the second passageway 02 includes an R21 section 021, an R22 section 022, an R23 section 023, an R24 section 024, and an R25 section 025 arranged in sequence. The R21 section 021 is located between the first fixed beam 11 and the third fixed beam 13 (for example, the R21 section 021 is located between the L11 side beam section 111 and the L31 side beam section 131). The R22 section 022 is located between the third fixed beam 13 and the fifth fixed beam 15 (for example, the R22 section 022 is located between the L52 side beam section 152 and the L32 side beam section 132). The R24 section 024 is located between the fourth fixed beam 14 and the sixth fixed beam 16 (for example, the R24 section 024 is located between the L43 side beam section 143 and the L63 side beam section 163). The R25 section 025 is located between the fourth fixed beam 14 and the second fixed beam 12 (for example, the R25 section 025 is located between the L44 side beam section 144 and the L23 side beam section 123). Therefore, the fixed beam assembly 1 has a simple structure, and the second passageway 02 can be defined easily and efficiently.

As shown in FIG. 3, the third passageway 03 includes an R31 section 031, an R32 section 032, an R33 section 033, an R34 section 034, and an R35 section 035 arranged in sequence. The R31 section 031 is located between the third fixed beam 13 and the second fixed beam 12 (for example, the R31 section 031 is located between the L21 side beam section 121 and the L34 side beam section 134). The R32 section 032 is located between the third fixed beam 13 and the sixth fixed beam 16 (for example, the R32 section 032 is located between the L33 side beam section 133 and the L62 side beam section 162). The R34 section 034 is located between the fifth fixed beam 15 and the sixth fixed beam 14 (for example, the R34 section 034 is located between the L42 side beam section 142 and the L53 side beam section 153). The R35 section 035 is located between the first fixed beam 11 and the fourth fixed beam 14 (for example, the R35 section 035 is located between the L41 side beam section 141 and the L13 side beam section 113). Therefore, the fixed beam assembly 1 has a simple structure, and the third passageway 03 can be defined easily and efficiently.

As shown in FIG. 3, the fourth passageway 04 includes an R41 section 041, an R42 section 042, and an R43 section 043 arranged in sequence. The R41 section 041 is located between the third fixed beam 13 and the second fixed beam 12 (for example, the R41 section 041 is located between the L34 side beam section 134 and the L21 side beam section 121). The R42 section 042 is located between the sixth fixed beam 16 and the second fixed beam 12 (for example, the R42 section 042 is located between the L61 side beam section 161 and the L22 side beam section 122). The R43 section 043 is located between the fourth fixed beam 14 and the second fixed beam 12 (for example, the R43 section 043 is located between the L44 side beam section 144 and the L23 side beam section 123). Therefore, the fixed beam assembly 1 has a simple structure, and the fourth passageway 04 can be defined easily and efficiently.

In some embodiments of this application, as shown in FIG. 3, at least (the center line of) a middle part of the R12 section 012 may extend along a straight line, at least (the center line of) a middle part of the R42 section 042 may extend along a straight line, and the extension line of (the center line of) the middle part of the R12 section 012 may be parallel to the extension line of (the center line of) the middle part of the R42 section 042. Certainly, this application is not limited thereto. For example, in some other embodiments of this application, the center line of the R12 section 012 may also extend along a curve, and the center line of the R42 section 042 may also extend along a curve.

In some embodiments of this application, as shown in FIG. 3, (the center line) of the R23 section 023 extends along a straight line, an extension line of (the center line of) at least a part of the R22 section 022 that is connected to the R23 section 023 coincides with an extension line of (the center line of) the R23 section 023, and an extension line of (the center line of) at least a part of the R24 section 024 that is connected to the R23 section 023 coincides with the extension line of (the center line of) the R23 section 023. Therefore, the vehicle 200 can pass smoothly when traveling from the R22 section 022 to the R24 section 024, thereby reducing the shaking of the vehicle 200 and improving the riding comfort. Moreover, the length of the second passageway 02 can be shortened, to ensure that the inner guide rail switch 100 has a small size.

In some embodiments of this application, as shown in FIG. 3, (the center line) of the R33 section 033 extends along a straight line, an extension line of (the center line of) at least a part of the R32 section 032 that is connected to the R33 section 033 coincides with an extension line of (the center line of) the R33 section 033, and an extension line of (the center line of) at least a part of the R34 section 034 that is connected to the R33 section 033 coincides with the extension line of (the center line of) the R33 section 033. Therefore, the vehicle 200 can pass smoothly when traveling from the R32 section 032 to the R34 section 034, thereby reducing the shaking of the vehicle 200 and improving the riding comfort. Moreover, the length of the third passageway 03 can be shortened, to ensure that the inner guide rail switch 100 has a small size.

In some embodiments of this application, as shown in FIG. 2 and FIG. 3, the first movable beam 21 is located on one side of the fifth fixed beam 15 close to the first fork 101 and is configured to translate between the first fixed beam 11 and the third fixed beam 13, and the first movable beam 21 includes an F11 surface 211 facing the first fixed beam 11 and an F12 surface 212 facing the third fixed beam 13. When the first movable beam 21 moves to a position where the F11 surface 211 is joined to a side surface of the fifth fixed beam 15 facing the first fixed beam 11 (as shown in FIG. 5), the first movable beam 21 and the first fixed beam 11 (for example, the L11 side beam section 111) constitute two side beams of the R11 section 011. When the first movable beam 21 moves to a position where the F12 surface 212 is joined to a side surface of the fifth fixed beam 15 facing the third fixed beam 13 (as shown in FIG. 6), the first movable beam 21 and the third fixed beam 13 (for example, the L31 side beam section 131) constitute two side beams of the R21 section 021. The first movable beam 21 may be an integrally formed part, i.e., an integral part. In other words, the first movable beam 21 is not assembled with a plurality of parts, and does not include a plurality of scattered parts.

It needs to be noted that the term "join" and variants thereof mentioned in this specification refers to smooth transition connection.

Therefore, the first movable beam 21 has a simple structure and can reliably move in the union area of the first passageway 01 and the second passageway 02, and switching between the first passageway 01 and the second passageway 02 can be easily and effectively realized by translational movement. In short, the first movable beam 21 has a simple structure and is easy to process, and the driving device for driving the first movable beam 21 to undergo translation movement has a simple structure and requires low energy consumption for driving.

Certainly, this application is not limited thereto. For example, in some other embodiments of this application, the first movable beam 21 may also include a plurality of components, which may or may not be connected. Each component may be driven by one driving device, and each component may also be driven to move along a curve, and so on, which will not be described in detail herein.

In some embodiments of this application, as shown in FIG. 5, when the first movable beam 21 moves to a position where the F11 surface 211 is joined to the side surface of the fifth fixed beam 15 facing the first fixed beam 11, the F12 surface 212 is in contact with the third fixed beam 13. In this way, the first fixed beam 11 can be used to support the first movable beam 21 to improve the stability of the first movable beam 21 when staying in the switching position, ensure a reliable guiding of the first movable beam 21 for the guide wheels 201, and ensure a reliable supporting of the first movable beam 21 for the walking wheels 202.

In some embodiments of this application, as shown in FIG. 6, when the first movable beam 21 moves to a position where the F12 surface 212 is joined to the side surface of the fifth fixed beam 15 facing the third fixed beam 13, the F11 surface 211 is in contact with the third fixed beam 11. In this way, the third fixed beam 13 can be used to support the first movable beam 21 to improve the stability of the first movable beam 21 when staying in the switching position, ensure reliable guiding of the first movable beam 21 for the guide wheels 201, and ensure reliable supporting of the first movable beam 21 for the walking wheels 202.

In some embodiments of this application, as shown in FIG. 2 and FIG. 3, the first movable beam 21 may further include an F13 surface 213 facing the fifth fixed beam 15, the F13 surface 213 extends along a direction parallel to a translation direction of the first movable beam 21, and the side surface of the fifth fixed beam 15 facing the first movable beam 21 is constructed as a planar structure parallel to the F13 surface 213. This means that the fifth fixed beam 15 is in surface contact with the first movable beam 21, so that there is a certain beam width at the position where the fifth fixed beam 15 and the first movable beam 21 are butted. In this way, when the walking wheels 202 of the vehicle 200 travel from the first movable beam 21 to the fifth fixed beam 15 (or from the fifth fixed beam 15 to the first movable beam 21), no wheel trapping will occur at the joint between the fifth fixed beam 15 and the first movable beam 21. Moreover, when the first movable beam 21 is joined to the fifth fixed beam 15, the F13 surface 213 can be used to form a surface contact with the above-mentioned planar structure of the fifth fixed beam 15 to reliably support the first movable beam 21, so as to ensure that the first movable beam 21 can stably stay in the switching position, ensure reliable guiding of the first movable beam 21 for the guide wheels 201, and ensure reliable supporting of the first movable beam 21 for the walking wheels 202.

In some embodiments of this application, as shown in FIG. 2 and FIG. 3, the second movable beam 22 is located on one side of the fifth fixed beam 15 close to the second fork 102 and is configured to translate between the first fixed beam 11 and the fourth fixed beam 14, and the second movable beam 22 includes an F21 surface 221 facing the first fixed beam 11 and an F22 surface 222 facing the fourth fixed beam 14. When the second movable beam 22 moves to a position where the F21 surface 221 is joined to a side surface of the fifth fixed beam 15 facing the first fixed beam 11 (as shown in FIG. 5), the second movable beam 22 and the first fixed beam 11 (for example, the L13 side beam section 113) constitute two side beams of the R13 section 013. When the second movable beam 22 moves to a position where the F22 surface 222 is joined to a side surface of the fifth fixed beam 15 facing the fourth fixed beam 14 (as shown in FIG. 6), the second movable beam 22 and the fourth fixed beam 14 (for example, the L41 side beam section 141) constitute two side beams of the R35 section 035. The second movable beam 22 may be an integrally formed part, i.e., an integral part. In other words, the second movable beam 22 is not assembled with a plurality of parts, and does not include a plurality of scattered parts.

Therefore, the second movable beam 22 has a simple structure and can reliably move in the union area of the first passageway 01 and the third passageway 03, and switching between the first passageway 01 and the third passageway 03 can be easily and effectively realized by translational movement. In short, the first movable beam 22 has a simple structure and is easy to process, and the driving device for driving the second movable beam 22 to undergo translation movement has a simple structure and requires low energy consumption for driving.

Certainly, this application is not limited thereto. For example, in some other embodiments of this application, the second movable beam 22 may also include a plurality of components, which may or may not be connected. Each component may be driven by one driving device, and each component may also be driven to move along a curve, and so on, which will not be described in detail herein.

In some embodiments of this application, as shown in FIG. 5, when the second movable beam 22 moves to a position where the F21 surface 221 is joined to the side surface of the fifth fixed beam 15 facing the first fixed beam 11, the F22 surface 222 is in contact with the fourth fixed beam 14. In this way, the fourth fixed beam 14 can be used to support the second movable beam 22 to improve the stability of the second movable beam 22 when staying in the switching position, ensure reliable guiding of the second movable beam 22 for the guide wheels 201, and ensure reliable supporting of the second movable beam 22 for the walking wheels 202.

In some embodiments of this application, as shown in FIG. 6, when the second movable beam 22 moves to a position where the F22 surface 222 is joined to the side surface of the fifth fixed beam 15 facing the fourth fixed beam 14, the F21 surface 221 is in contact with the first fixed beam 11. In this way, the first fixed beam 11 can be used to support the second movable beam 22 to improve the stability of the second movable beam 22 when staying in the switching position, ensure reliable guiding of the second movable beam 22 for the guide wheels 201, and ensure reliable supporting of the second movable beam 22 for the walking wheels 202.

In some embodiments of this application, as shown in FIG. 2 and FIG. 3, the second movable beam 22 may further include an F23 surface 223 facing the fifth fixed beam 15, the F23 surface 223 extends along a direction parallel to a translation direction of the second movable beam 22, and the side surface of the fifth fixed beam 15 facing the second movable beam 22 is constructed as a planar structure parallel to the F23 surface 223. This means that the fifth fixed beam 15 is in surface contact with the second movable beam 22, so that there is a certain beam width at the position where the fifth fixed beam 15 and the second movable beam 22 are butted. In this way, when the walking wheels 202 of the vehicle 200 travel from the second movable beam 22 to the fifth fixed beam 15 (or from the fifth fixed beam 15 to the second movable beam 22), no wheel trapping will occur at the joint between the fifth fixed beam 15 and the second movable beam 22. Moreover, when the second movable beam 22 is joined to the fifth fixed beam 15, the F23 surface 223 can be used to form a surface contact with the above-mentioned planar structure of the fifth fixed beam 15 to reliably support the second movable beam 22, so as to ensure that the second movable beam 22 can stably stay in the switching position, ensure reliable guiding of the second movable beam 22 for the guide wheels 201, and ensure reliable supporting of the second movable beam 22 for the walking wheels 202.

In some embodiments of this application, as shown in FIG. 2 and FIG. 3, the third movable beam 23 is located on a side of the sixth fixed beam 16 close to the third fork 103 and configured to translate between the second fixed beam 12 and the fourth fixed beam 14, and the third movable beam 23 includes an F31 surface 231 facing the second fixed beam 12 and an F32 surface 232 facing the fourth fixed beam 14. When the third movable beam 23 moves to a position where the F31 surface 231 is joined to a side surface of the sixth fixed beam 16 facing the second fixed beam 12 (as shown in FIG. 5), the third movable beam 23 and the second fixed beam 12 (for example, the L23 side beam section 123) constitute two side beams of the R43 section 043. When the third movable beam 23 moves to a position where the F32 surface 232 is joined to a side surface of the sixth fixed beam 16 facing the fourth fixed beam 14 (as shown in FIG. 6), the third movable beam 23 and the fourth fixed beam 14 (for example, the L44 side beam section 144) constitute two side beams of the R25 section 025. The third movable beam 23 may be an integrally formed part, i.e., an integral part. In other words, the third movable beam 23 is not assembled with a plurality of parts, and does not include a plurality of scattered parts.

Therefore, the third movable beam 23 has a simple structure and can reliably move in the union area of the second passageway 02 and the fourth passageway 04, and switching between the second passageway 02 and the fourth passageway 04 can be easily and effectively realized by translational movement. In short, the third movable beam 23 has a simple structure and is easy to process, and the driving device for driving the third movable beam 23 to undergo translation movement has a simple structure and requires low energy consumption for driving.

Certainly, this application is not limited thereto. For example, in some other embodiments of this application, the third movable beam 23 may also include a plurality of components, which may or may not be connected. Each component may be driven by one driving device, and each component may also be driven to move along a curve, and so on, which will not be described in detail herein.

In some embodiments of this application, as shown in FIG. 5, when the third movable beam 23 moves to a position where the F31 surface 231 is joined to the side surface of the sixth fixed beam 16 facing the second fixed beam 12, the F32 surface 232 is in contact with the fourth fixed beam 14. In this way, the fourth fixed beam 14 can be used to support the third movable beam 23 to improve the stability of the third movable beam 23 when staying in the switching position, ensure reliable guiding of the third movable beam 23 for the guide wheels 201, and ensure reliable supporting of the third movable beam 23 for the walking wheels 202.

In some embodiments of this application, as shown in FIG. 6, when the third movable beam 23 moves to a position where the F32 surface 232 is joined to the side surface of the sixth fixed beam 16 facing the fourth fixed beam 14, the F31 surface 231 is in contact with the second fixed beam 12. In this way, the second fixed beam 12 can be used to support the third movable beam 23 to improve the stability of the third movable beam 23 when staying in the switching position, ensure reliable guiding of the third movable beam 23 for the guide wheels 201, and ensure reliable supporting of the third movable beam 23 for the walking wheels 202.

In some embodiments of this application, as shown in FIG. 2 and FIG. 3, the third movable beam 23 further includes an F33 surface 233 facing the sixth fixed beam 16, the F33 surface 233 extends along a direction parallel to a translation direction of the third movable beam 23, and a side surface of the sixth fixed beam 16 facing the third movable beam 23 is constructed as a planar structure parallel to the F33 surface 233. This means that the sixth fixed beam 16 is in surface contact with the third movable beam 23, so that there is a certain beam width at the position where the sixth fixed beam 16 and the third movable beam 23 are butted. In this way, when the walking wheels 202 of the vehicle 200 travel from the third movable beam 23 to the sixth fixed beam 16 (or from the sixth fixed beam 16 to the third movable beam 23), no wheel trapping will occur at the joint between the sixth fixed beam 16 and the third movable beam 23. Moreover, when the third movable beam 23 is joined to the sixth fixed beam 16, the F33 surface 233 can be used to form a surface contact with the above-mentioned planar structure of the sixth fixed beam 16 to reliably support the third movable beam 23, so as to ensure that the third movable beam 23 can stably stay in the switching position, ensure reliable guiding of the third movable beam 23 for the guide wheels 201, and ensure reliable supporting of the third movable beam 23 for the walking wheels 202.

In some embodiments of this application, as shown in FIG. 2 and FIG. 3, the fourth movable beam 24 is located on a side of the sixth fixed beam 16 close to the fourth fork 104 and configured to translate between the second fixed beam 12 and the third fixed beam 13, and the fourth movable beam 24 includes an F41 surface 241 facing the second fixed beam 12 and an F42 surface 242 facing the third fixed beam 13. When the fourth movable beam 24 moves to a position where the F41 surface 241 is joined to a side surface of the sixth fixed beam 16 facing the second fixed beam 12 (as shown in FIG. 5), the fourth movable beam 24 and the second fixed beam 12 (for example, the L21 side beam section 121) constitute two side beams of the R41 section 041. When the fourth movable beam 24 moves to a position where the F42 surface 242 is joined to a side surface of the sixth fixed beam 16 facing the third fixed beam 13 (as shown in FIG. 6), the fourth movable beam 24 and the third fixed beam 13 (for example, the L34 side beam section 134) constitute two side beams of the R31 section 031. The fourth movable beam 24 may be an integrally formed part, i.e., an integral part. In other words, the fourth movable beam 24 is not assembled with a plurality of parts, and does not include a plurality of scattered parts.

Therefore, the fourth movable beam 24 has a simple structure and can reliably move in the union area of the third passageway 03 and the fourth passageway 04, and switching between the third passageway 03 and the fourth passageway 04 can be easily and effectively realized by translational movement. In short, the fourth movable beam 24 has a simple structure and is easy to process, and the driving device for driving the fourth movable beam 24 to undergo translation movement has a simple structure and requires low energy consumption for driving.

Certainly, this application is not limited thereto. For example, in some other embodiments of this application, the fourth movable beam 24 may also include a plurality of components, which may or may not be connected. Each component may be driven by one driving device, and each component may also be driven to move along a curve, and so on, which will not be described in detail herein.

In some embodiments of this application, as shown in FIG. 5, when the fourth movable beam 24 moves to a position where the F41 surface 241 is joined to the side surface of the sixth fixed beam 16 facing the second fixed beam 12, the F42 surface 242 is in contact with the third fixed beam 13. In this way, the third fixed beam 13 can be used to support the fourth movable beam 24 to improve the stability of the fourth movable beam 24 when staying in the switching position, ensure reliable guiding of the fourth movable beam 24 for the guide wheels 201, and ensure reliable supporting of the fourth movable beam 24 for the walking wheels 202.

In some embodiments of this application, as shown in FIG. 6, when the fourth movable beam 24 moves to a position where the F42 surface 242 is joined to the side surface of the sixth fixed beam 16 facing the third fixed beam 13, the F41 surface 241 is in contact with the second fixed beam 12. In this way, the second fixed beam 12 can be used to support the fourth movable beam 24 to improve the stability of the fourth movable beam 24 when staying in the switching position, ensure reliable guiding of the fourth movable beam 24 for the guide wheels 201, and ensure reliable supporting of the fourth movable beam 24 for the walking wheels 202.

In some embodiments of this application, as shown in FIG. 2 and FIG. 3, the third movable beam 24 further includes an F43 surface 243 facing the sixth fixed beam 16, the F43 surface 243 extends along a direction parallel to a translation direction of the fourth movable beam 24, and a side surface of the sixth fixed beam 16 facing the fourth movable beam 24 is constructed as a planar structure parallel to the F43 surface 243. This means that the sixth fixed beam 16 is in surface contact with the fourth movable beam 24, so that there is a certain beam width at the position where the sixth fixed beam 16 and the fourth movable beam 24 are butted. In this way, when the walking wheels 202 of the vehicle 200 travel from the fourth movable beam 24 to the sixth fixed beam 16 (or from the sixth fixed beam 16 to the fourth movable beam 24), no wheel trapping will occur at the joint between the sixth fixed beam 16 and the fourth movable beam 24. Moreover, when the fourth movable beam 24 is joined to the sixth fixed beam 16, the F13 surface 213 can be used to form a surface contact with the above-mentioned planar structure of the sixth fixed beam 16 to reliably support the fourth movable beam 24, so as to ensure that the fourth movable beam 24 can stably stay in the switching position, ensure reliable guiding of the fourth movable beam 24 for the guide wheels 201, and ensure reliable supporting of the fourth movable beam 24 for the walking wheels 202.

In some embodiments of this application, as shown in FIG. 2 and FIG. 3, the fifth movable beam 25 is located on a side of the third fixed beam 13 close to the fourth fork 104 and configured to translate between the fifth fixed beam 15 and the sixth fixed beam 16, and the fifth movable beam 25 includes an F51 surface 251 facing the fifth fixed beam 15 and an F52 surface 252 facing the sixth fixed beam 16. The sixth movable beam 26 is located between the fourth fixed beam 14 and the fifth movable beam 25 and configured to reciprocally translate between the fifth fixed beam 15 and the sixth fixed beam 16, and the sixth movable beam 26 includes an F61 surface 261 facing the fifth fixed beam 15 and an F62 surface 262 facing the sixth fixed beam 16. The fifth movable beam 25 may be an integrally formed part, i.e., an integral part. In other words, the fifth movable beam 25 is not assembled with a plurality of parts, and does not include a plurality of scattered parts. The sixth movable beam 26 may be an integrally formed part, i.e., an integral part. In other words, the sixth movable beam 26 is not assembled with a plurality of parts, and does not include a plurality of scattered parts.

As shown in FIG. 2 and FIG. 5, when the fifth movable beam 25 moves to a position where the F52 surface 252 is joined between a side surface of the third fixed beam 13 facing the sixth fixed beam 16 and the side surface of the fifth fixed beam 15 facing the fourth fixed beam 14, and the sixth movable beam 26 moves to a position where the F61 surface 261 is joined between the side surface of the sixth fixed beam 16 facing the third fixed beam 13 and a side surface of the fourth fixed beam 14 facing the fifth fixed beam 15. The fifth movable beam 25 and the sixth movable beam 26 constitute two side beams of the R33 section 033.

As shown in FIG. 2 and FIG. 6, when the fifth movable beam 25 moves to a position where the F51 surface 251 is joined between a side surface of the third fixed beam 13 facing the fifth fixed beam 15 and the side surface of the sixth fixed beam 16 facing the fourth fixed beam 14, and the sixth movable beam 26 moves to a position where the F62 surface 262 is joined between the side surface of the fifth fixed beam 15 facing the third fixed beam 13 and a side surface of the fourth fixed beam 14 facing the sixth fixed beam 16. The fifth movable beam 25 and the sixth movable beam 26 constitute two side beams of the R23 section 023.

Therefore, the fifth movable beam 25 has a simple structure and can reliably move in the union area of the second passageway 02 and the third passageway 03, and switching between the second passageway 02 and the third passageway 03 can be easily and effectively realized by translational movement. In short, the fifth movable beam 25 has a simple structure and is easy to process, and the driving device for driving the fifth movable beam 25 to undergo translation movement has a simple structure and requires low energy consumption for driving. Similarly, the sixth movable beam 26 has a simple structure and can reliably move in the union area of the second passageway 02 and the third passageway 03, and switching between the second passageway 02 and the third passageway 03 can be easily and effectively realized by translational movement. In short, the sixth movable beam 26 has a simple structure and is easy to process, and the driving device for driving the sixth movable beam 26 to undergo translation movement has a simple structure and requires low energy consumption for driving.

Certainly, this application is not limited thereto. For example, in some other embodiments of this application, the fifth movable beam 25 may also include a plurality of components, which may or may not be connected. Each component may be driven by one driving device, and each component may also be driven to move along a curve, and so on, which will not be described in detail herein. Similarly, for example, in other embodiments of this application, the sixth movable beam 26 may also include a plurality of components, which may or may not be connected. Each component may be driven by one driving device, and each component may also be driven to move along a curve, and so on, which will not be described in detail herein.

In some embodiments of this application, as shown in FIG. 5, when the sixth movable beam 26 moves to a position where the F61 surface 261 is joined between the side surface of the sixth fixed beam 16 facing the third fixed beam 13 and a side surface of the fourth fixed beam 14 facing the fifth fixed beam 15, the F62 surface 262 is in contact with the sixth fixed beam 16 (for example, when the F62 surface 262 is planar and the side surface of the sixth fixed beam 16 facing the fourth fixed beam 14 is also planar, the F62 surface 262 may entirely be in surface contact with the sixth fixed beam 16). In this way, the sixth fixed beam 16 can be used to support the sixth movable beam 26 to improve the stability of the sixth movable beam 26 when staying in the switching position, ensure reliable guiding of the sixth movable beam 26 for the guide wheels 201, and ensure reliable supporting of the sixth movable beam 26 for the walking wheels 202.

In some embodiments of this application, as shown in FIG. 6, when the sixth movable beam 26 moves to a position where the F62 surface 262 is joined between the side surface of the fifth fixed beam 15 facing the third fixed beam 13 and a side surface of the fourth fixed beam 14 facing the sixth fixed beam 16, the F61 surface 261 is in contact with the fifth fixed beam 15 (for example, when the F61 surface 261 is planar and the side surface of the fifth fixed beam 15 facing the fourth fixed beam 14 is also planar, the F61 surface 261 may entirely be in surface contact with the fifth fixed beam 15). In this way, the fifth fixed beam 15 can be used to support the sixth movable beam 26 to improve the stability of the sixth movable beam 26 when staying in the switching position, ensure reliable guiding of the sixth movable beam 26 for the guide wheels 201, and ensure reliable supporting of the sixth movable beam 26 for the walking wheels 202.

In some embodiments of this application, as shown in FIG. 6, when the fifth movable beam 25 moves to a position where the F51 surface 251 is joined between the side surface of the third fixed beam 13 facing the fifth fixed beam 15 and a side surface of the sixth fixed beam 16 facing the fourth fixed beam 14, the F52 surface 252 is in contact with the sixth fixed beam 16 (for example, when the F52 surface 252 is planar and the side surface of the sixth fixed beam 16 facing the third fixed beam 13 is also planar, the F52 surface 252 may entirely be in surface contact with the sixth fixed beam 16). In this way, the sixth fixed beam 16 can be used to support the sixth movable beam 25 to improve the stability of the fifth movable beam 25 when staying in the switching position, ensure reliable guiding of the fifth movable beam 25 for the guide wheels 201, and ensure reliable supporting of the fifth movable beam 25 for the walking wheels 202.

In some embodiments of this application, as shown in FIG. 5, when the fifth movable beam 25 moves to a position where the F52 surface 252 is joined between the side surface of the third fixed beam 13 facing the sixth fixed beam 16 and a side surface of the fifth fixed beam 15 facing the fourth fixed beam 14, the F51 surface 251 is in contact with the sixth fixed beam 15 (for example, when the F51 surface 251 is planar and the side surface of the fifth fixed beam 15 facing the third fixed beam 13 is also planar, the F51 surface 251 may entirely be in surface contact with the fifth fixed beam 15). In this way, the sixth fixed beam 15 can be used to support the fifth movable beam 25 to improve the stability of the fifth movable beam 25 when staying in the switching position, ensure reliable guiding of the fifth movable beam 25 for the guide wheels 201, and ensure reliable supporting of the fifth movable beam 25 for the walking wheels 202.

In some embodiments of this application, as shown in FIG. 2 and FIG. 3, the fifth movable beam 25 may further include an F53 surface 253 facing the third fixed beam 13, the F53 surface 253 extends along a direction parallel to a translation direction of the fifth movable beam 25, and a side surface of the third fixed beam 13 facing the fifth movable beam 25 is constructed as a planar structure parallel to the F53 surface 253. This means that the third fixed beam 13 is configured for surface contact with the fifth movable beam 25, so that there is a certain beam width at the position where the third fixed beam 13 and the fifth movable beam 25 are butted. In this way, when the walking wheels 202 of the vehicle 200 travel from the fifth movable beam 25 to the third fixed beam 13 (or from the third fixed beam 13 to the fifth movable beam 25), no wheel trapping will occur at the joint between the third fixed beam 13 and the fifth movable beam 25. Moreover, when the fifth movable beam 25 is joined to the third fixed beam 13, the F53 surface 253 can be used to form a surface contact with the above-mentioned planar structure of the third fixed beam 13 to reliably support the fifth movable beam 25, so as to ensure that the fifth movable beam 25 can stably stay in the switching position, ensure reliable guiding of the fifth movable beam 25 for the guide wheels 201, and ensure reliable supporting of the fifth movable beam 25 for the walking wheels 202.

In some embodiments of this application, as shown in FIG. 2 and FIG. 3, the sixth movable beam 26 further includes an F63 surface 263 facing the fourth fixed beam 14, the F63 surface 263 extends along a direction parallel to a translation direction of the sixth movable beam 26, a side surface of the fourth fixed beam 14 facing the sixth movable beam 26 is constructed as a planar structure parallel to the F63 surface 263, and the F63 surface 263 is parallel to the F53 surface 253. This means that the fourth fixed beam 14 is in surface contact with the sixth movable beam 26, so that there is a certain beam width at the position where the fourth fixed beam 14 and the sixth movable beam 26 are butted. In this way, when the walking wheels 202 of the vehicle 200 travel from the sixth movable beam 26 to the fourth fixed beam 14 (or from the fourth fixed beam 14 to the sixth movable beam 26), no wheel trapping will occur at the joint between the fourth fixed beam 14 and the sixth movable beam 26. Moreover, when the sixth movable beam 26 is joined to the fourth fixed beam 14, the F13 surface 213 can be used to form a surface contact with the above-mentioned planar structure of the fourth fixed beam 14 to reliably support the sixth movable beam 26, so as to ensure that the sixth movable beam 26 can stably stay in the switching position, ensure reliable guiding of the sixth movable beam 26 for the guide wheels 201, and ensure reliable supporting of the sixth movable beam 26 for the walking wheels 202.

In addition, the specific structure and shape of the inner guide rail switch 100 according to the embodiments of this application are not limited, and may be as shown in FIG. 1-FIG. 22, for example. An inner guide rail switch 100 according to several embodiments of this application will be described below with reference to the accompanying drawings.

Embodiment 1

As shown in FIG. 1-FIG. 3 and FIG. 5-FIG. 7, the inner guide rail switch 100 includes: a fixed beam assembly 1 and a movable beam assembly 2. The fixed beam assembly 1 is a fixed track beam 300. The movable beam assembly 2 can translate. Through the combination of moving the movable beams of the movable beam assembly 2, passage in different routes can be realized. As shown in FIG. 1-FIG. 3, the inner guide rail switch 100 includes a fixed beam assembly 1 and a movable beam assembly 2. The fixed beam assembly 1 includes six fixed beams, namely, a first fixed beam 11 to a sixth fixed beam 16. The bottom of each fixed beam is supported by a support base, and the support base is welded to a rail switch platform, so as to fix the fixed beam. The movable beam assembly 2 includes six movable beams which can translate, namely, a first movable beam 21 to a sixth movable beam 26. The second movable beam 22 and the fourth movable beam 24 are rightward-open movable beams. The first movable beam 21 and the third movable beam 23 are leftward-open movable beams. The fifth and sixth movable beams 25 and 26 are horizontal movable beams. The bottom of each movable beam is equipped with a trolley device, and a driving device is provided on the trolley device.

The driving device is configured to drive the trolley device to translate, so as to drive the movable beam to translate, thereby realizing route switching to switch among passage-permitted states.

As shown in FIG. 3, four forks and four passageways are defined by the fixed beam assembly 1. The four forks are a first fork 101, a second fork 102, a third fork 103, and a fourth fork 104. Lines connecting the four forks form a quadrilateral. The first fork 101 and the third fork 103 are arranged diagonally. The four passageways are a first passageway 01, a second passageway 02, a third passageway 03, and a fourth passageway 04. The first passageway 01 connects the first fork 101 and the second fork 102, the second passageway 02 connects the first fork 101 and the third fork 103, the third passageway 03 connects the fourth fork 104 and the second fork 102, and the fourth passageway 04 connects the fourth fork 104 and the third fork 103.

As shown in FIG. 3, the first fixed beam 11 extends from the first fork 101 to the second fork 102, and includes an L11 side beam section 111, an L12 side beam section 112, and an L13 side beam section 113 arranged in sequence along a direction from the first fork 101 to the second fork 102, so that the first fixed beam 11 is a strip beam including the L11 side beam section 111, the L12 side beam section 112, and the L13 side beam section 113. The second fixed beam 12 extends from the fourth fork 104 to the third fork 103, and includes an L21 side beam section 121, an L22 side beam section 122, and an L23 side beam section 123 arranged in sequence along a direction from the fourth fork 104 to the third fork 103, so that the second fixed beam 12 is a strip beam including the L21 side beam section 121, the L22 side beam section 122, and the L23 side beam section 123.

As shown in FIG. 3, the third fixed beam 13 and the fourth fixed beam 14 are both located between the first fixed beam 11 and the second fixed beam 12, and the third fixed beam 13 and the fourth fixed beam 14 are arranged in sequence along the direction from the first fork 101 to the second fork 102. The third fixed beam 13 includes an L31 side beam section 131, an L32 side beam section 132, an L33 side beam section 133, and an L34 side beam section 134 arranged in sequence along a direction from the first fork 101 to the fourth fixed beam 14 and then to the fourth fork 104. The L31 side beam section 131 and the L32 side beam section 132 are arranged close to the first fixed beam 11 and form an A1 beam. The L33 side beam section 133 and the L34 side beam section 134 are arranged close to the second fixed beam 12 and form an A2 beam. The A1 beam and the A2 beam form a "V"-shaped beam with an opening facing away from the fourth fixed beam 14. The fourth fixed beam 14 includes an L41 side beam section 141, an L42 side beam section 142, an L43 side beam section 143, and an L44 side beam section 144 arranged in sequence along a direction from the second fork 102 to the third fixed beam 13 and then to the third fork 103. The L41 side beam section 141 and the L42 side beam section 142 are arranged close to the first fixed beam 11 and form a B1 beam. The L43 side beam section 143 and the L44 side beam section 144 are arranged close to the second fixed beam 12 and form a B2 beam. The B1 beam and the B2 beam form a "V"-shaped beam with an opening facing away from the third fixed beam 13.

As shown in FIG. 3, the fifth fixed beam 15 is located on a side of the third fixed beam 13 and the fourth fixed beam 14 close to the first fixed beam 11. The fifth fixed beam 15 is arranged opposite to a middle part of the first fixed beam 11. The fifth fixed beam 15 includes an L51 side beam section 151, an L52 side beam section 152, and an L53 side beam section 153 arranged in sequence. The L51 side beam section 151, the L52 side beam section 152, and the L53 side beam section 153 constitute three sides of a triangle. The L51 side beam section 151 is disposed facing the L12 side beam section 112 of the first fixed beam 11. The L52 side beam section 152 is disposed facing the L32 side beam section 132 of the third fixed beam 13. The L53 side beam section 153 is disposed facing the L42 side beam section 142 of the four fixed beam 14.

As shown in FIG. 3, the sixth fixed beam 16 is located on a side of the third fixed beam 13 and the fourth fixed beam 14 close to the second fixed beam 12. The sixth fixed beam 16 is arranged opposite to a middle part of the second fixed beam 12. The sixth fixed beam 16 includes an L61 side beam section 161, an L62 side beam section 162, and an L63 side beam section 163 arranged in sequence. The L61 side beam section 161, the L62 side beam section 162, and the L63 side beam section 163 constitute three sides of a triangle. The L61 side beam section 161 is disposed facing the L22 side beam section 122 of the first fixed beam 12. The L62 side beam section 162 is disposed facing the L33 side beam section 133 of the third fixed beam 13. The L63 side beam section 163 is disposed facing the L43 side beam section 143 of the four fixed beam 14.

As shown in FIG. 3, the first passageway 01 includes an R11 section 011, an R12 section 012, and an R13 section 013 arranged in sequence. The R11 section 011 is located between the L11 side beam section 111 and the L31 side beam section 131. The R12 section 012 is located between the L12 side beam section 112 and the L51 side beam section 151. The R13 section 013 is located between the L13 side beam section 113 and the L41 side beam section 141.

As shown in FIG. 3, the second passageway 02 includes an R21 section 021, an R22 section 022, an R23 section 023, an R24 section 024, an R25 section 025 arranged in sequence. The R21 section 021 is located between the L11 side beam section 111 and the L31 side beam section 131. The R22 section 022 is located between the L52 side beam section 152 and the L32 side beam section 132. The R24 section 024 is located between the L43 side beam section 143 and the L63 side beam section 163. The R25 section 025 is located between the L44 side beam section 144 and the L23 side beam section 123.

As shown in FIG. 3, the third passageway 03 includes an R31 section 031, an R32 section 032, an R33 section 033, an R34 section 034, an R35 section 035 arranged in sequence. The R31 section 031 is located between the L21 side beam section 121 and the L34 side beam section 134. The R32 section 032 is located between the L33 side beam section 133 and the L62 side beam section 162. The R34 section 034 is located between the L42 side beam section 142 and the L53 side beam section 153. The R35 section 035 is located between the L41 side beam section 141 and the L13 side beam section 113.

As shown in FIG. 3, the fourth passageway 04 includes an R41 section 041, an R42 section 042, and an R43 section 043 arranged in sequence. The R41 section 041 is located between the L34 side beam section 134 and the L21 side beam section 121. The R42 section 042 is located between the L61 side beam section 161 and the L22 side beam section 122. The R43 section 043 is located between the L44 side beam section 144 and the L23 side beam section 123.

As shown in FIG. 2 and FIG. 3, the first movable beam 21 is configured to translate in a union area of the R11 section 011 and the R21 section 021, so that one of the R11 section 011 and the R21 section 021 allows passage and the other is blocked. The second movable beam 22 is configured to translate in a union area of the R13 section 013 and the R35 section 035, so that one of the R13 section 013 and the R35 section 035 allows passage and the other is blocked. The third movable beam 23 is configured to translate in a union area of R25 section 025 and the R43 section 043, so that one of R25 section 025 and the R43 section 043 allows passage and the other is blocked. The fourth movable beam 24 is configured to translate in a union area of the R31 section 031 and the R41 section 041, so that one of the R31 section 031 and the R41 section 041 allows passage and the other is blocked.

As shown in FIG. 2 and FIG. 3, the fifth movable beam 25 is located on a side of the third fixed beam 13 close to the fourth fixed beam 14 and is configured to translate between the L52 side beam section 152 and the L62 side beam section 162, so as to connect the R22 section 022 to the R23 section 023 and disconnect the R32 section 032 from the R33 section 033, or disconnect the R22 section 022 from the R23 section 023 and connect the R32 section 032 to the R33 section 033. The sixth movable beam 26 is located on a side of the fourth fixed beam 14 close to the third fixed beam 13 and is configured to translate between the L53 side beam section 153 and the L63 side beam section 163, so as to connect the R24 section 024 to the R23 section 023 and disconnect the R34 section 034 from the R33 section 033, or disconnect the R24 section 024 from the R23 section 023 and connect the R34 section 034 to the R33 section 033.

In Embodiment 1, the first passageway 01 and the fourth passageway 04 are passageways on two sides, the second passageway 02 and the third passageway 03 are passageways crossing each other, and the first passageway 01, the second passageway 02, the third passageway 03, and the fourth passageway 04 are all passageways extending along a smooth line. Along the direction from left to right in the figure, the first passageway 01 and the fourth passageway 04 are parallel straight passageways, the second passageway 02 is a "curve-curve" passageway, and the third passageway 03 is a "curve-curve" passageway. Specifically, the R11 section 011 is a straight passageway section, the R12 section 012 is a straight passageway section, and the R13 section 013 is a straight passageway section. The R21 section 021 is a curved passageway section, the R22 section 022 is a transitional passageway section between a straight line and a curve, the R23 section 023 is a straight passageway section, the R24 section 024 is a transitional passageway section between a straight line and a curve, and the R25 section 025 is a curved passageway section. The R31 section 031 is a curved passageway section, the R32 section 032 is a transitional passageway section between a straight line and a curve, the R33 section 033 is a straight passageway section, the R34 section 034 is a transitional passageway section between a straight line and a curve, and the R35 section 035 is a curved passageway section. The R41 section 041 is a straight passageway section, the R42 section 042 is a straight passageway section, and the R43 section 043 is a straight passageway section.

As shown in FIG. 5, when the first movable beam 21 and the second movable beam 22 are driven by the driving device to translate away from the first fixed beam 11, and the third movable beam 23 and the fourth movable beam 24 are driven by the driving device to translate away from the second fixed beam 12, both the first passageway 01 and the fourth passageway 04 allow passage. In this case, the inner guide rail switch 100 presents at a first passage-permitted state and a fourth passage-permitted state. In this case, the first fixed beam 11 can be used as a side beam on one side of the width of the first passageway 01 (and the beam width of the side beam may be greater than the width of the walking wheels 202 of the vehicle 200), and (the L31 side beam section 131 of) the third fixed beam 13, the first movable beam 21, (the L51 side beam section 151 of) the fifth fixed beam 15, the second movable beam 22, and (the L41 side beam section 141 of) the fourth fixed beam 14 are joined and used as a side beam on the other side of the width of the first passageway 01 (and the beam width of the side beam may be greater than the width of the walking wheels 202 of the vehicle 200), so that the guide wheels 201 of the vehicle 200 can pass between the side beams on the two sides of the width of the first passageway 01, and the walking wheels 202 of the vehicle 200 can respectively be supported by and travel on the side beams on the two sides of the width of the first passageway 01. In this case, the second fixed beam 12 can be used as a side beam on one side of the width of the fourth passageway 04 (and the beam width of the side beam may be greater than the width of the walking wheels 202 of the vehicle 200), and (the L34 side beam section 134 of) the third fixed beam 13, the fourth movable beam 24, (the L61 side beam section 161 of) the sixth fixed beam 16, the third movable beam 23, and (the L44 side beam section 144 of) the fourth fixed beam 14 are joined and used as a side beam on the other side of the width of the fourth passageway 04 (and the beam width of the side beam may be greater than the width of the walking wheels 202 of the vehicle 200), so that the guide wheels 201 of the vehicle 200 can pass between the side beams on the two sides of the width of the fourth passageway 04, and the walking wheels 202 of the vehicle 200 can respectively be supported by and travel on the side beams on the two sides of the width of the fourth passageway 04.

As shown in FIG. 6, when the first movable beam 21 and the second movable beam 22 are driven by the driving device to translate toward the first fixed beam 11, the third movable beam 23 and the fourth movable beam 24 are driven by the driving device to translate toward the second fixed beam 12, and the fifth movable beam 25 and the sixth movable beam 26 both translate to their right side (that is, the fifth movable beam 25 translates toward the sixth fixed beam 16 and the sixth movable beam 26 translates toward the fifth fixed beam 15), the second passageway 02 allows passage. In this case, the inner guide rail switch 100 presents at a second passage-permitted state. In this case, (the L11 side beam section 111 of) the first fixed beam 11, the first movable beam 21, (the L52 side beam section 152 of) the fifth fixed beam 15, the sixth movable beam 26, and (the L43 side beam section 143 and the L44 side beam section 144 of) the fourth fixed beam 14 are joined and used as a side beam on one side of the width of the second passageway 02 (and the beam width of the side beam may be greater than the width of the walking wheels 202 of the vehicle 200), and (the L31 side beam section 131 and the L32 side beam section 132 of) the third fixed beam 13, the fourth movable beam 25, (the L63 side beam section 163 of) the sixth fixed beam 16, the third movable beam 23, and (the L23 side beam section 123 of) the second fixed beam 12 are joined and used as a side beam on the other side of the width of the fourth passageway 02 (and the beam width of the side beam may be greater than the width of the walking wheels 202 of the vehicle 200), so that the guide wheels 201 of the vehicle 200 can pass between the side beams on the two sides of the width of the second passageway 02, and the walking wheels 202 of the vehicle 200 can respectively be supported by and travel on the side beams on the two sides of the width of the second passageway 02.

As shown in FIG. 7, when the first movable beam 21 and the second movable beam 22 are driven by the driving device to translate toward the first fixed beam 11, the third movable beam 23 and the fourth movable beam 24 are driven by the driving device to translate toward the second fixed beam 12, and the fifth movable beam 25 and the sixth movable beam 26 both translate to their left side (that is, the fifth movable beam 25 translates toward the fifth fixed beam 15 and the sixth movable beam 26 translates toward the sixth fixed beam 16), the third passageway 03 allows passage. In this case, the inner guide rail switch 100 presents at a third passage-permitted state. In this case, (the L21 side beam section 121 of) the second fixed beam 12, the fourth movable beam 24, (the L62 side beam section 162 of) the sixth fixed beam 16, the sixth movable beam 26, and (the L42 side beam section 142 and the L41 side beam section 141 of) the fourth fixed beam 14 are joined and used as a side beam on one side of the width of the third passageway 03 (and the beam width of the side beam may be greater than the width of the walking wheels 202 of the vehicle 200), and (the L34 side beam section 134 and the L33 side beam section 133 of) the third fixed beam 13, the fifth movable beam 25, (the L53 side beam section 153 of) the fifth fixed beam 15, the second movable beam 22, and (the L13 side beam section 113 of) the first fixed beam 11 are joined and used as a side beam on the other side of the width of the third passageway 03 (and the beam width of the side beam may be greater than the width of the walking wheels 202 of the vehicle 200), so that the guide wheels 201 of the vehicle 200 can pass between the side beams on the two sides of the width of the third passageway 03, and the walking wheels 202 of the vehicle 200 can respectively be supported by and travel on the side beams on the two sides of the width of the third passageway 03.

Therefore, the inner guide rail switch 100 of this embodiment of this application is small in size, cost-effective and reasonable, and route switching can be realized by moving only the movable beam assembly 2.

Embodiment 2

Figure 9:
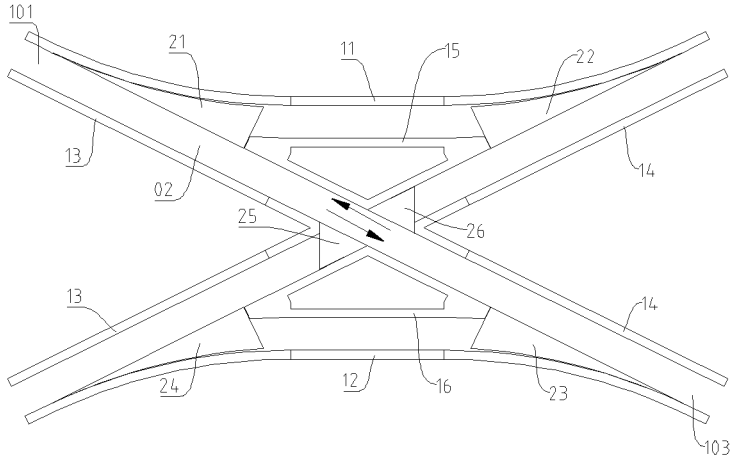
FIG. 9 is a schematic diagram showing a second passage-permitted state of the inner guide rail switch of FIG. 8.
Figure 10:
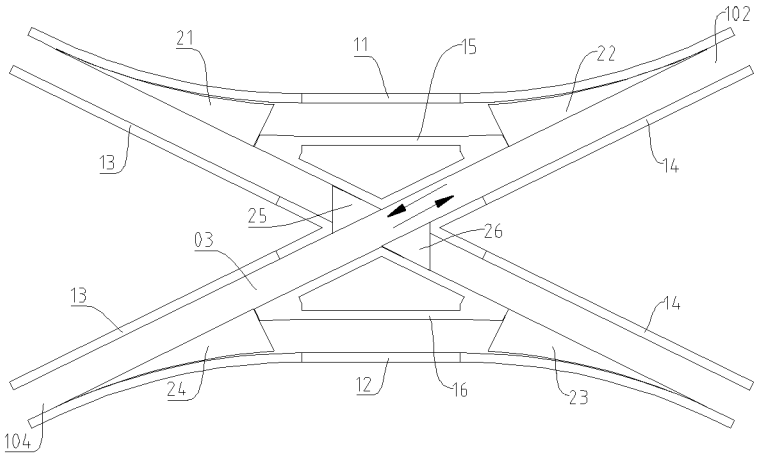
FIG. 10 is a schematic diagram showing a third passage-permitted state of the inner guide rail switch of FIG. 8.

As shown in FIG. 8-FIG. 10, the structure of Embodiment 2 is basically the same as that of Embodiment 1, where the same components are denoted by the same reference numerals, except that the shapes of the four passageways are different.

As shown in FIG. 8-FIG. 10, the first passageway 01 and the fourth passageway 04 are passageways on two sides, the second passageway 02 and the third passageway 03 are passageways crossing each other, and the first passageway 01, the second passageway 02, the third passageway 03, and the fourth passageway 04 are all passageways extending along a smooth line. Along the direction from left to right in the figure, the second passageway 02 and the third passageway 03 are both straight passageways, the first passageway 01 is a "curve-curve" passageway, and the fourth passageway 04 is a "curve-curve" passageway. The R11 section 011 is a curved passageway section, the R12 section 012 is a transitional passageway section between a curve and a straight line, and the R13 section 013 is a curved passageway section. The R21 section 021 is a straight passageway section, the R22 section 022 is a straight passageway section, the R23 section 023 is a straight passageway section, the R24 section 024 is a straight passageway section, and the R25 section 025 is a straight passageway section. The R31 section 031 is a straight passageway section, the R32 section 032 is a straight passageway section, the R33 section 033 is a straight passageway section, the R34 section 034 is a straight passageway section, and the R35 section 035 is a straight passageway section. The R41 section 041 is a curved passageway section, the R42 section 042 is a transitional passageway section between a curve and a straight line, and the R43 section 043 is a curved passageway section.

Embodiment 3

Figure 11:
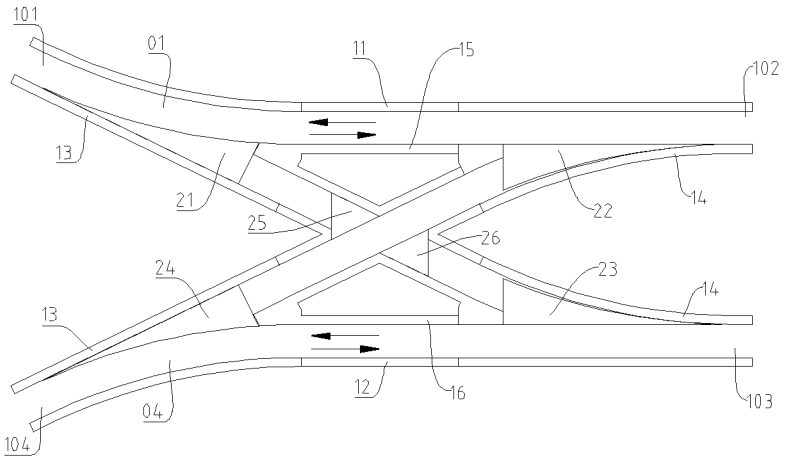
FIG. 11 is a schematic diagram of an inner guide rail switch at a first passage-permitted state and a fourth passage-permitted state according to another embodiment of this application.
Figure 12:
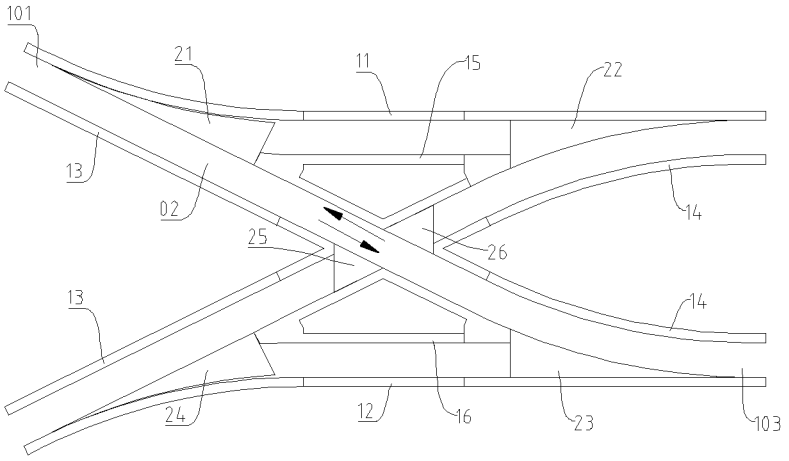
FIG. 12 is a schematic diagram showing a second passage-permitted state of the inner guide rail switch of FIG. 11.
Figure 13:
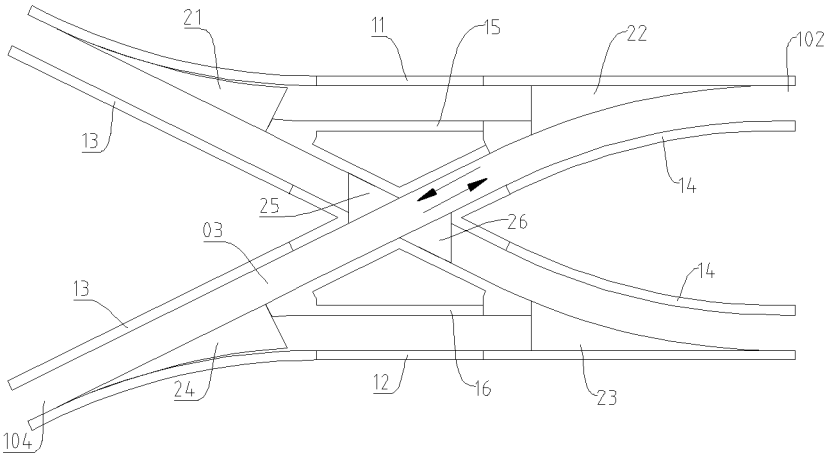
FIG. 13 is a schematic diagram showing a third passage-permitted state of the inner guide rail switch of FIG. 11.

As shown in FIG. 11-FIG. 13, the structure of Embodiment 3 is basically the same as that of Embodiment 1, where the same components are denoted by the same reference numerals, except that the shapes of the four passageways are different.

As shown in FIG. 11-FIG. 13, the first passageway 01 and the fourth passageway 04 are passageways on two sides, the second passageway 02 and the third passageway 03 are passageways crossing each other, and the first passageway 01, the second passageway 02, the third passageway 03, and the fourth passageway 04 are all passageways extending along a smooth line. Along the direction from left to right in the figure, the first passageway 01 is a "curve-straight" passageway, the second passageway 02 is a "straight-curve" passageway, the third passageway 03 is a "straight-curve" passageway, and the fourth passageway 04 is a "curve-straight" passageway. Specifically, the R11 section 011 is a curved passageway section, the R12 section 012 is a transitional passageway section between a curve and a straight line, and the R13 section 013 is a straight passageway section. The R21 section 021 is a straight passageway section, the R22 section 022 is a straight passageway section, the R23 section 023 is a straight passageway section, the R24 section 024 is a transitional passageway section between a curve and a straight line, and the R25 section 025 is a curved passageway section. The R31 section 031 is a straight passageway section, the R32 section 032 is a straight passageway section, the R33 section 033 is a straight passageway section, the R34 section 034 is a transitional passageway section between a curve and a straight line, and the R35 section 035 is a curved passageway section. The R41 section 041 is a curved passageway section, the R42 section 042 is a transitional passageway section between a curve and a straight line, and the R43 section 043 is a straight passageway section.

Embodiment 4

Figure 14:
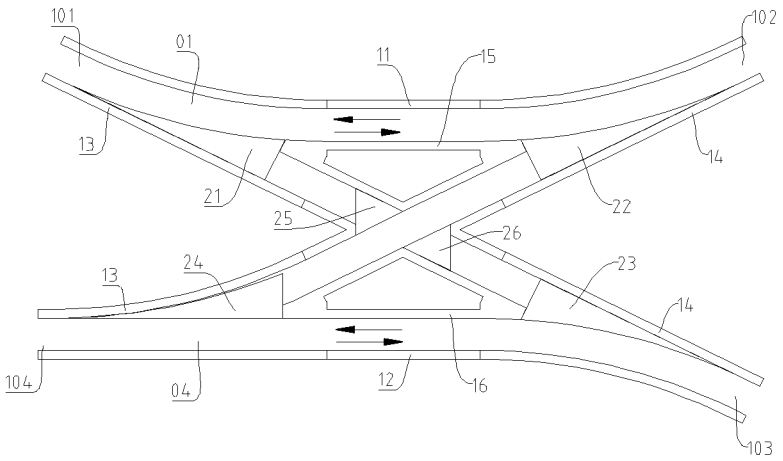
FIG. 14 is a schematic diagram of an inner guide rail switch at a first passage-permitted state and a fourth passage-permitted state according to another embodiment of this application.
Figure 15:
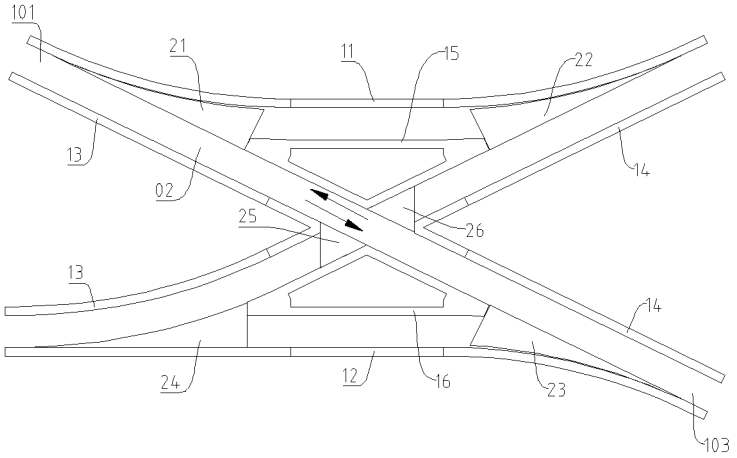
FIG. 15 is a schematic diagram showing a second passage-permitted state of the inner guide rail switch of FIG. 14.
Figure 16:
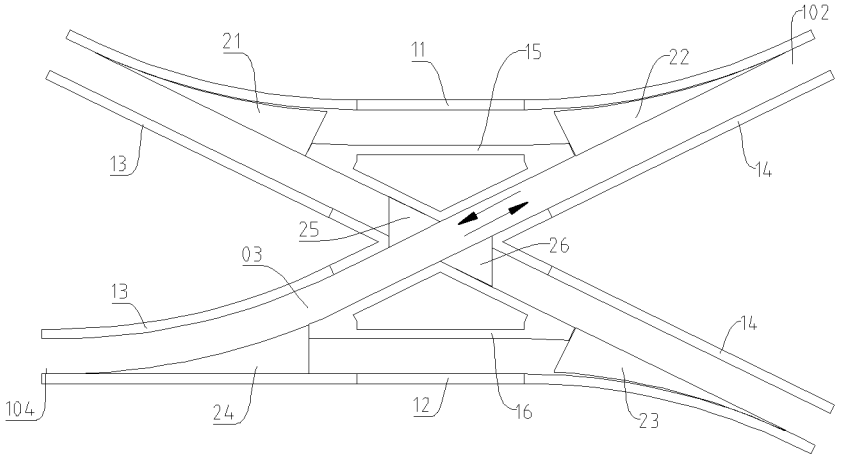
FIG. 16 is a schematic diagram showing a third passage-permitted state of the inner guide rail switch of FIG. 14.

As shown in FIG. 14-FIG. 16, the structure of Embodiment 4 is basically the same as that of Embodiment 1, where the same components are denoted by the same reference numerals, except that the shapes of the four passageways are different.

As shown in FIG. 14-FIG. 16, the first passageway 01 and the fourth passageway 04 are passageways on two sides, the second passageway 02 and the third passageway 03 are passageways crossing each other, and the first passageway 01, the second passageway 02, the third passageway 03, and the fourth passageway 04 are all passageways extending along a smooth line. Along the direction from left to right in the figure, the first passageway 01 is a "curve-curve" passageway, the second passageway 02 is a straight passageway, the third passageway 03 is a "curve-straight" passageway, and the fourth passageway 04 is a "straight-curve" passageway. Specifically, the R11 section 011 is a curved passageway section, the R12 section 012 is a transitional passageway section between a curve and a straight line, and the R13 section 013 is a curved passageway section. The R21 section 021 is a straight passageway section, the R22 section 022 is a straight passageway section, the R23 section 023 is a straight passageway section, the R24 section 024 is a straight passageway section, and the R25 section 025 is a straight passageway section. The R31 section 031 is a curved passageway section, the R32 section 032 is a transitional passageway section between a curve and a straight line, the R33 section 033 is a straight passageway section, the R34 section 034 is a straight passageway section, and the R35 section 035 is a straight passageway section. The R41 section 041 is a straight passageway section, the R42 section 042 is a transitional passageway section between a curve and a straight line, and the R43 section 043 is a curved passageway section.

Embodiment 5

Figure 17:
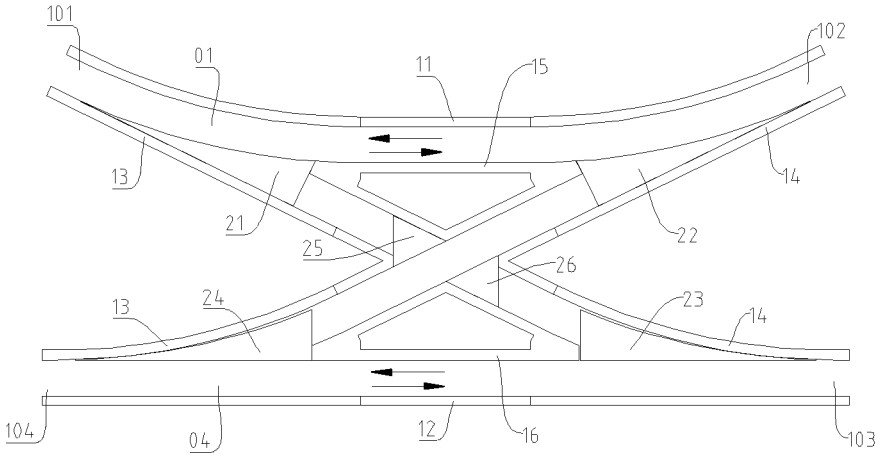
FIG. 17 is a schematic diagram of an inner guide rail switch at a first passage-permitted state and a fourth passage-permitted state according to another embodiment of this application.
Figure 18:
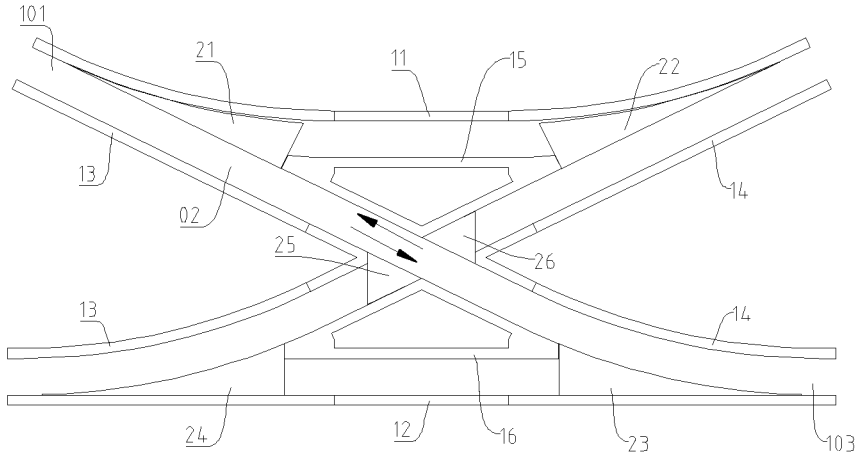
FIG. 18 is a schematic diagram showing a second passage-permitted state of the inner guide rail switch of FIG. 17.
Figure 19:
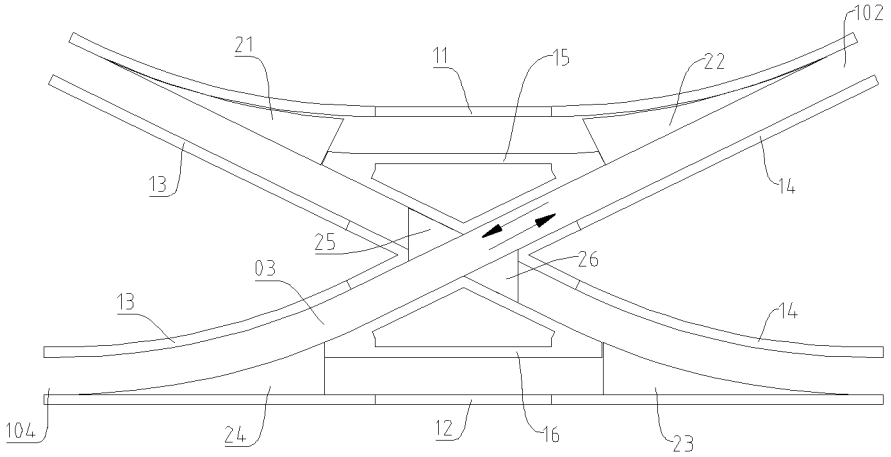
FIG. 19 is a schematic diagram showing a third passage-permitted state of the inner guide rail switch of FIG. 17.

As shown in FIG. 17-FIG. 19, the structure of Embodiment 5 is basically the same as that of Embodiment 1, where the same components are denoted by the same reference numerals, except that the shapes of the four passageways are different.

As shown in FIG. 17-FIG. 19, the first passageway 01 and the fourth passageway 04 are passageways on two sides, the second passageway 02 and the third passageway 03 are passageways crossing each other, and the first passageway 01, the second passageway 02, the third passageway 03, and the fourth passageway 04 are all passageways extending along a smooth line. Along the direction from left to right in the figure, the first passageway 01 is a "curve-curve" passageway, the second passageway 02 is a "straight-curve" passageway, the third passageway 03 is a "curve-straight" passageway, and the fourth passageway 04 is a straight passageway. Specifically, the R11 section 011 is a curved passageway section, the R12 section 012 is a transitional passageway section between a curve and a straight line, and the R13 section 013 is a curved passageway section. The R21 section 021 is a straight passageway section, the R22 section 022 is a straight passageway section, the R23 section 023 is a straight passageway section, the R24 section 024 is a transitional passageway section between a curve and a straight line, and the R25 section 025 is a curved passageway section. The R31 section 031 is a curved passageway section, the R32 section 032 is a transitional passageway section between a curve and a straight line, the R33 section 033 is a straight passageway section, the R34 section 034 is a straight passageway section, and the R35 section 035 is a straight passageway section. The R41 section 041 is a straight passageway section, the R42 section 042 is a straight passageway section, and the R43 section 043 is a straight passageway section.

Embodiment 6

Figure 20:
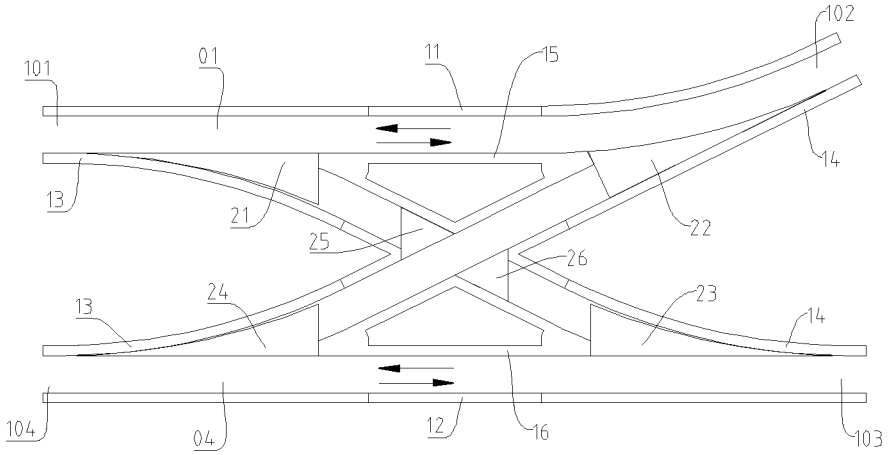
FIG. 20 is a schematic diagram of an inner guide rail switch at a first passage-permitted state and a fourth passage-permitted state according to another embodiment of this application.
Figure 21:
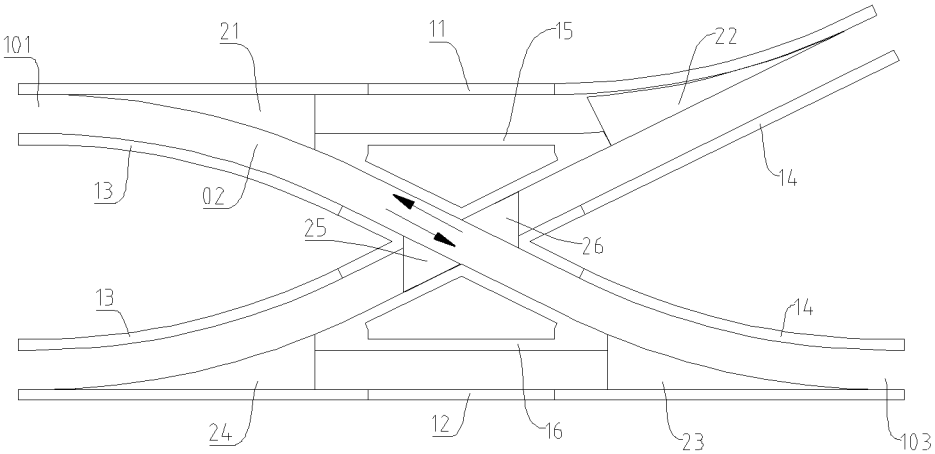
FIG. 21 is a schematic diagram showing a second passage-permitted state of the inner guide rail switch of FIG. 20.
Figure 22:
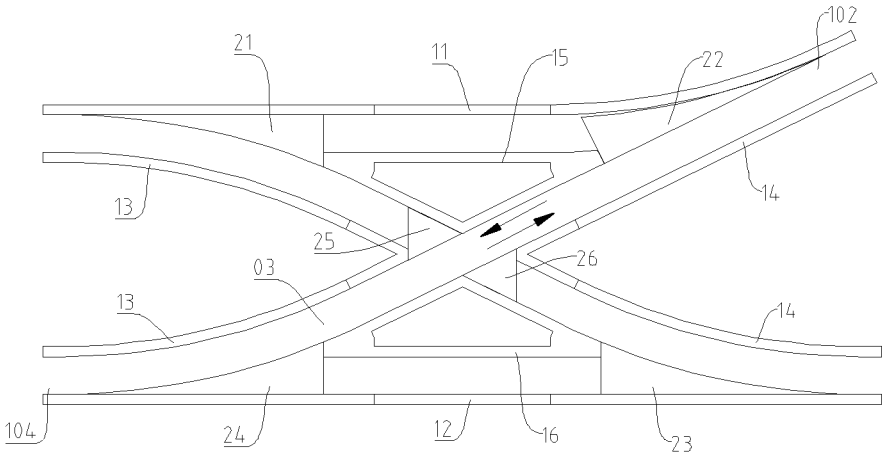
FIG. 22 is a schematic diagram showing a third passage-permitted state of the inner guide rail switch of FIG. 20.
Figure 23:
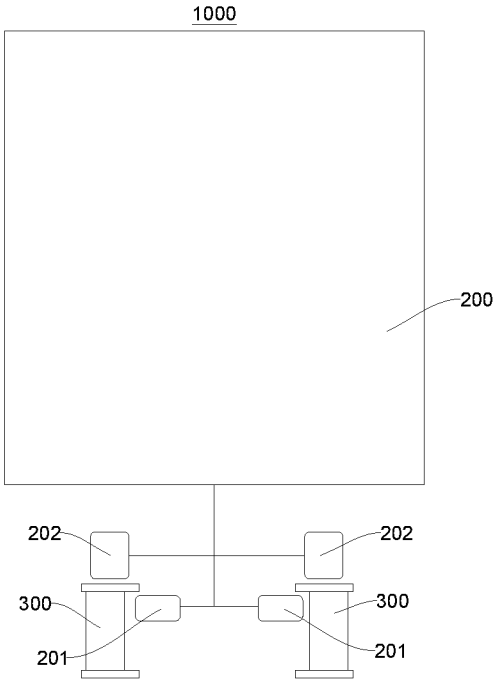
FIG. 23 is a schematic diagram of a rail transit system according to an embodiment of this application.

As shown in FIG. 20-FIG. 22, the structure of Embodiment 6 is basically the same as that of Embodiment 1, where the same components are denoted by the same reference numerals, except that the shapes of the four passageways are different.

As shown in FIG. 20-FIG. 22, the first passageway 01 and the fourth passageway 04 are passageways on two sides, the second passageway 02 and the third passageway 03 are passageways crossing each other, and the first passageway 01, the second passageway 02, the third passageway 03, and the fourth passageway 04 are all passageways extending along a smooth line. Along the direction from left to right in the figure, the first passageway 01 is a "straight-curve" passageway, the second passageway 02 is a "curve-curve" passageway, the third passageway 03 is a "curve-straight" passageway, and the fourth passageway 04 is a straight passageway. Specifically, the R11 section 011 is a straight passageway section, the R12 section 012 is a transitional passageway section between a curve and a straight line, and the R13 section 013 is a curved passageway section. The R21 section 021 is a curved passageway section, the R22 section 022 is a transitional passageway section between a curve and a straight line, the R23 section 023 is a straight passageway section, the R24 section 024 is a transitional passageway section between a curve and a straight line, and the R25 section 025 is a curved passageway section. The R31 section 031 is a curved passageway section, the R32 section 032 is a transitional passageway section between a curve and a straight line, the R33 section 033 is a straight passageway section, the R34 section 034 is a straight passageway section, and the R35 section 035 is a straight passageway section. The R41 section 041 is a straight passageway section, the R42 section 042 is a straight passageway section, and the R43 section 043 is a straight passageway section.

In the description of the present specification, the description of the reference terms "an embodiment", "some embodiments", "specific example", "some examples" or the like means that specific features, structures, materials or characteristics described in combination with the embodiment are included in at least one embodiment of this application. In the present specification, the illustrative expression of the above terms is not necessarily referring to the same embodiment or example. Moreover, the described specific features, structures, materials or characteristics may be combined in any suitable manners in one or more embodiments. In addition, where there are no contradictions, the various embodiments or examples described in this specification and features of various embodiments or examples can be combined by those skilled in the art.

Although the embodiments of this application have been shown and described, persons of ordinary skill in the art should understand that various changes, modifications, replacements and variations may be made to the embodiments without departing from the principles and spirit of this application, and the scope of this application is as defined by the appended claims and their equivalents.

What is claimed is:

1. An inner guide rail switch, comprising:

a fixed beam assembly, wherein the fixed beam assembly comprises:

four forks, wherein the four forks comprise a first fork, a second fork, a third fork, and a fourth fork, the four forks are respectively located at four corners of a quadrilateral, the first fork and the third fork are arranged diagonally, and the second fork and the fourth fork are arranged diagonally; and four passageways, wherein the four passageways comprise a first passageway, a second passageway, a third passageway, a fourth passageway, the first passageway connects the first fork and the second fork, the second passageway connects the first fork and the third fork, the third passageway connects the fourth fork and the second fork, and the fourth passageway connects the fourth fork and the third fork; and a movable beam assembly, wherein the movable beam assembly comprises:

a first movable beam, wherein the first movable beam is movably arranged at the first fork and is configured to switch one of the first passageway and the second passageway to allow passage;

a second movable beam, wherein the second movable beam is movably arranged at the second fork and is configured to switch one of the first passageway and the third passageway to allow passage;

a third movable beam, wherein the third movable beam is movably arranged at the third fork and is configured to switch one of the second passageway and the fourth passageway to allow passage;

a fourth movable beam, wherein the fourth movable beam is movably arranged at the fourth fork and is configured to switch one of the third passageway and the fourth passageway to allow passage;

a fifth movable beam, wherein the fifth movable beam is movably arranged on one side of an intersection of the second passageway and the third passageway close to the first fork and the fourth fork, and is configured to switch one of the second passageway and the third passageway to allow passage; and a sixth movable beam, wherein the sixth movable beam is movably arranged on one side of the intersection of the second passageway and the third passageway close to the second fork and the third fork, and is configured to switch one of the second passageway and the third passageway to allow passage.

2. The inner guide rail switch according to claim 1, wherein the fixed beam assembly comprises:

a first fixed beam and a second fixed beam, wherein the first fixed beam extends from the first fork to the second fork, and the second fixed beam extends from the fourth fork to the third fork;

a third fixed beam and a fourth fixed beam, wherein the third fixed beam and the fourth fixed beam are both located between the first fixed beam and the second fixed beam, and the third fixed beam is arranged close to the first fork and the fourth fork relative to the fourth fixed beam; and a fifth fixed beam and a sixth fixed beam, wherein the fifth fixed beam is located on one side of the third fixed beam and the fourth fixed beam close to the first fixed beam, and the sixth fixed beam is located on one side of the third fixed beam and the fourth fixed beam close to the second fixed beam;

wherein the first passageway comprises an R11 section, an R12 section, and an R13 section arranged in sequence, the R11 section is located between the first fixed beam and the third fixed beam, the R12 section is located between the first fixed beam and the fifth fixed beam, and the R13 section is located between the first fixed beam and the fourth fixed beam;

wherein the second passageway comprises an R21 section, an R22 section, an R23 section, an R24 section, and an R25 section arranged in sequence, the R21 section is located between the first fixed beam and the third fixed beam, the R22 section is located between the third fixed beam and the fifth fixed beam, the R24 section is located between the fourth fixed beam and the sixth fixed beam, and the R25 section is located between the fourth fixed beam and the second fixed beams;

wherein the third passageway comprises an R31 section, an R32 section, an R33 section, an R34 section, and an R35 section arranged in sequence, the R31 section is located between the third fixed beam and the second fixed beam, the R32 section is located between the third fixed beam and the sixth fixed beam, the R34 section is located between the fifth fixed beam and the fourth fixed beam, and the R35 section is located between the first fixed beam and the fourth fixed beam; and wherein the fourth passageway comprises an R41 section, an R42 section, and an R43 section arranged in sequence, the R41 section is located between the third fixed beam and the second fixed beams, the R42 section is located between the sixth fixed beam and the second fixed beam, and the R43 section is located between the fourth fixed beam and the second fixed beam.

3. The inner guide rail switch according to claim 2, wherein an extension line of at least a part of the R22 section that is connected to the R23 section coincides with an extension line of the R23 section, and an extension line of at least a part of the R24 section that is connected to the R23 section coincides with the extension line of the R23 section; and wherein an extension line of at least a part of the R32 section that is connected to the R33 section coincides with an extension line of the R33 section, and an extension line of at least a part of the R34 section that is connected to the R33 section coincides with the extension line of the R33 section.

4. The inner guide rail switch according to claim 2, wherein the first movable beam is located on one side of the fifth fixed beam close to the first fork and is configured to translate between the first fixed beam and the third fixed beam, and the first movable beam comprises an F11 surface facing the first fixed beam and an F12 surface facing the third fixed beam, and wherein when the first movable beam moves to a position where the F11 surface is joined to a side surface of the fifth fixed beam facing the first fixed beam, the first movable beam and the first fixed beam constitute two side beams of the R11 section, and when the first movable beam moves to a position where the F12 surface is joined to a side surface of the fifth fixed beam facing the third fixed beam, the first movable beam and the third fixed beam constitute two side beams of the R21 section.

5. The inner guide rail switch according to claim 4, wherein when the first movable beam moves to a position where the F11 surface is joined to the side surface of the fifth fixed beam facing the first fixed beam, the F12 surface is in contact with the third fixed beam, and when the first movable beam moves to a position where the F12 surface is joined to the side surface of the fifth fixed beam facing the third fixed beam, the F11 surface is in contact with the first fixed beam; and wherein the first movable beam further comprises an F13 surface facing the fifth fixed beam, the F13 surface extends along a direction parallel to a translation direction of the first movable beam, and the side surface of the fifth fixed beam facing the first movable beam is constructed as a planar structure parallel to the F13 surface.

6. The inner guide rail switch according to claim 2, wherein the second movable beam is located on a side of the fifth fixed beam close to the second fork and configured to translate between the first fixed beam and the fourth fixed beam, and the second movable beam comprises an F21 surface facing the first fixed beam and an F22 surface facing the fourth fixed beam, and wherein when the second movable beam moves to a position where the F21 surface is joined to a side surface of the fifth fixed beam facing the first fixed beam, the second movable beam and the first fixed beam constitute two side beams of the R13 section, and when the second movable beam moves to a position where the F22 surface is joined to a side surface of the fifth fixed beam facing the fourth fixed beam, the second movable beam and the fourth fixed beam constitute two side beams of the R35 section.

7. The inner guide rail switch according to claim 6, wherein when the second movable beam moves to a position where the F21 surface is joined to the side surface of the fifth fixed beam facing the first fixed beam, the F22 surface is in contact with the fourth fixed beam, and when the second movable beam moves to a position where the F22 surface is joined to the side surface of the fifth fixed beam facing the fourth fixed beam, the F21 surface is in contact with the first fixed beam; and wherein the second movable beam further comprises an F23 surface facing the fifth fixed beam, the F23 surface extends along a direction parallel to a translation direction of the second movable beam, and a side surface of the fifth fixed beam facing the second movable beam is constructed as a planar structure parallel to the F23 surface.

8. The inner guide rail switch according to claim 2, wherein the third movable beam is located on a side of the sixth fixed beam close to the third fork and configured to translate between the second fixed beam and the fourth fixed beam, and the third movable beam comprises an F31 surface facing the second fixed beam and an F32 surface facing the fourth fixed beam, and wherein when the third movable beam moves to a position where the F31 surface is joined to a side surface of the sixth fixed beam facing the second fixed beam, the third movable beam and the second fixed beam constitute two side beams of the R43 section, and when the third movable beam moves to a position where the F32 surface is joined to a side surface of the sixth fixed beam facing the fourth fixed beam, the third movable beam and the fourth fixed beam constitute two side beams of the R25 section.

9. The inner guide rail switch according to claim 8, wherein when the third movable beam moves to a position where the F31 surface is joined to the side surface of the fifth fixed beam facing the second fixed beam, the F32 surface is in contact with the fourth fixed beam, and when the third movable beam moves to a position where the F32 surface is joined to the side surface of the fifth fixed beam facing the fourth fixed beam, the F31 surface is in contact with the second fixed beam.

10. The inner guide rail switch according to claim 8, wherein the third movable beam further comprises an F33 surface facing the sixth fixed beam, the F33 surface extends along a direction parallel to a translation direction of the third movable beam, and a side surface of the sixth fixed beam facing the third movable beam is constructed as a planar structure parallel to the F33 surface.

11. The inner guide rail switch according to claim 2, wherein the fourth movable beam is located on a side of the sixth fixed beam close to the fourth fork and configured to translate between the second fixed beam and the third fixed beam, and the fourth movable beam comprises an F41 surface facing the second fixed beam and an F42 surface facing the third fixed beam, and wherein when the fourth movable beam moves to a position where the F41 surface is joined to a side surface of the sixth fixed beam facing the second fixed beam, the fourth movable beam and the second fixed beam constitute two side beams of the R41 section, and when the fourth movable beam moves to a position where the F42 surface is joined to a side surface of the sixth fixed beam facing the third fixed beam, the fourth movable beam and the third fixed beam constitute two side beams of the R31 section.

12. The inner guide rail switch according to claim 11, wherein when the fourth movable beam moves to a position where the F41 surface is joined to the side surface of the sixth fixed beam facing the second fixed beam, the F42 surface is in contact with the third fixed beam, and when the fourth movable beam moves to a position where the F42 surface is joined to the side surface of the sixth fixed beam facing the fourth fixed beam, the F41 surface is in contact with the second fixed beam; and wherein the fourth movable beam further comprises an F43 surface facing the sixth fixed beam, the F43 surface extends along a direction parallel to a translation direction of the fourth movable beam, and a side surface of the sixth fixed beam facing the fourth movable beam is constructed as a planar structure parallel to the F43 surface.

13. The inner guide rail switch according to claim 2, wherein the fifth movable beam is located on a side of the third fixed beam close to the fourth fork and configured to translate between the fifth fixed beam and the sixth fixed beam, and the fifth movable beam comprises an F51 surface facing the fifth fixed beam and an F52 surface facing the sixth fixed beam, the sixth movable beam is located between the fourth fixed beam and the fifth movable beam and configured to translate between the fifth fixed beam and the sixth fixed beam, and the sixth movable beam comprises an F61 surface facing the fifth fixed beam and an F62 surface facing the sixth fixed beam, when the fifth movable beam moves to a position where the F51 surface is joined between a side surface of the third fixed beam facing the fifth fixed beam and the side surface of the sixth fixed beam facing the fourth fixed beam, and the sixth movable beam moves to a position where the F62 surface is joined between the side surface of the fifth fixed beam facing the third fixed beam and a side surface of the fourth fixed beam facing the sixth fixed beam, the fifth movable beam and the sixth movable beam constitute two side beams of the R23 section, and when the fifth movable beam moves to a position where the F52 surface is joined between a side surface of the third fixed beam facing the sixth fixed beam and the side surface of the fifth fixed beam facing the fourth fixed beam, and the sixth movable beam moves to a position where the F61 surface is joined between the side surface of the sixth fixed beam facing the third fixed beam and a side surface of the fourth fixed beam facing the fifth fixed beam, the fifth movable beam and the sixth movable beam constitute two side beams of the R33 section.

14. The inner guide rail switch according to claim 13, wherein when the fifth movable beam moves to a position where the F51 surface and is joined between the side surface of the third fixed beam facing the fifth fixed beam and the side surface of the sixth fixed beam facing the fourth fixed beam, the F52 surface is in contact with the sixth fixed beam, and when the fifth movable beam moves to a position where the F52 surface is joined between the side surface of the third fixed beam facing the sixth fixed beam and the side surface of the fifth fixed beam facing the fourth fixed beam, the F51 surface is in contact with the fifth fixed beam, and when the sixth movable beam moves to a position where the F62 surface is joined between the side surface of the fifth fixed beam facing the third fixed beam and a side surface of the fourth fixed beam facing the sixth fixed beam, the F61 surface is in contact with the fifth fixed beam, and when the sixth movable beam moves to a position where the F61 surface is joined between the side surface of the sixth fixed beam facing the third fixed beam and the side surface of the fourth fixed beam facing the fifth fixed beam, the F62 surface is in contact with the sixth fixed beam; and wherein the fifth movable beam further comprises an F53 surface facing the third fixed beam, the F53 surface extends along a direction parallel to a translation direction of the fifth movable beam, and a side surface of the third fixed beam facing the fifth movable beam is constructed as a planar structure parallel to the F53 surface, and the sixth movable beam further comprises an F63 surface facing the fourth fixed beam, the F63 surface extends along a direction parallel to a translation direction of the sixth movable beam, a side surface of the fourth fixed beam facing the sixth movable beam is constructed as a planar structure parallel to the F63 surface, and the F63 surface is parallel to the F53 surface.

15. A rail transit system, comprising: an inner guide rail switch, wherein the inner guide rail switch comprises:

a fixed beam assembly, wherein the fixed beam assembly comprises:

four forks, wherein the four forks comprise a first fork, a second fork, a third fork, and a fourth fork, the four forks are respectively located at four corners of a quadrilateral, the first fork and the third fork are arranged diagonally, and the second fork and the fourth fork are arranged diagonally; and four passageways, wherein the four passageways comprise a first passageway, a second passageway, a third passageway, a fourth passageway, the first passageway connects the first fork and the second fork, the second passageway connects the first fork and the third fork, the third passageway connects the fourth fork and the second fork, and the fourth passageway connects the fourth fork and the third fork; and a movable beam assembly, wherein the movable beam assembly comprises:

a first movable beam, wherein the first movable beam is movably arranged at the first fork and is configured to switch one of the first passageway and the second passageway to allow passage;

a second movable beam, wherein the second movable beam is movably arranged at the second fork and is configured to switch one of the first passageway and the third passageway to allow passage;

a third movable beam, wherein the third movable beam is movably arranged at the third fork and is configured to switch one of the second passageway and the fourth passageway to allow passage;

a fourth movable beam, wherein the fourth movable beam is movably arranged at the fourth fork and is configured to switch one of the third passageway and the fourth passageway to allow passage;

a fifth movable beam, wherein the fifth movable beam is movably arranged on one side of an intersection of the second passageway and the third passageway close to the first fork and the fourth fork, and is configured to switch one of the second passageway and the third passageway to allow passage; and a sixth movable beam, wherein the sixth movable beam is movably arranged on one side of the intersection of the second passageway and the third passageway close to the second fork and the third fork, and is configured to switch one of the second passageway and the third passageway to allow passage.

* * * * *